US009105239B2

(12) United States Patent
Ohashi et al.

(10) Patent No.: US 9,105,239 B2
(45) Date of Patent: Aug. 11, 2015

(54) IMAGE PROCESSING DEVICE, IMAGE PROCESSING METHOD, RECORDING MEDIUM, AND PROGRAM

(75) Inventors: Takeshi Ohashi, Tokyo (JP); Jun Yokono, Tokyo (JP); Takuya Narihira, Tokyo (JP)

(73) Assignees: Sony Corporation (JP); Japanese Foundation For Cancer Research (JP)

( * ) Notice: Subject to any disclaimer, the term of this patent is extended or adjusted under 35 U.S.C. 154(b) by 371 days.

(21) Appl. No.: 13/477,521

(22) Filed: May 22, 2012

(65) Prior Publication Data

US 2012/0306934 A1 Dec. 6, 2012

(30) Foreign Application Priority Data

Jun. 3, 2011 (JP) ..... 2011-125100

(51) Int. Cl.
*G09G 5/00* (2006.01)
*G09G 5/34* (2006.01)

(52) U.S. Cl.
CPC ..... *G09G 5/34* (2013.01); *G09G 2380/08* (2013.01)

(58) Field of Classification Search
CPC ..... G06F 17/30; G06F 3/048; G09G 5/00; G09G 5/34; G09G 2380/08; G06T 3/40; G06T 13/00; G06T 3/60
USPC ..... 345/22, 83, 472, 593, 594, 660, 661, 345/676, 684
See application file for complete search history.

(56) References Cited

U.S. PATENT DOCUMENTS

| | | | | |
|---|---|---|---|---|
| 2007/0276225 | A1* | 11/2007 | Kaufman et al. | 600/416 |
| 2009/0067700 | A1* | 3/2009 | Maton et al. | 382/132 |
| 2009/0161927 | A1* | 6/2009 | Mori et al. | 382/128 |
| 2009/0210809 | A1* | 8/2009 | Bacus et al. | 715/764 |
| 2009/0231362 | A1* | 9/2009 | Kaba et al. | 345/660 |
| 2010/0063842 | A1* | 3/2010 | Carroll et al. | 705/3 |
| 2011/0102467 | A1* | 5/2011 | Kudo et al. | 345/660 |

FOREIGN PATENT DOCUMENTS

| | | | |
|---|---|---|---|
| JP | H01111816A | A | 4/1989 |
| JP | 2002253545 | A | 9/2002 |
| JP | 2006-228185 | A | 8/2006 |
| JP | 2010509971 | A | 4/2010 |

OTHER PUBLICATIONS

JP Office Action for JP Application No. 2011125100, dated Mar. 17, 2015.

* cited by examiner

*Primary Examiner* — Jason M Repko
*Assistant Examiner* — Michael Le
(74) *Attorney, Agent, or Firm* — Lerner, David, Littenberg, Krumholz & Mentlik, LLP

(57) ABSTRACT

There is provided an image processing device including a movement section which scrolls a medical image on a screen, and a display control section which, in a case where the medical image is scrolled on the screen, controls a display section to display the medical image in a manner that an observation reference position of a diagnosis region of the medical image passes through a display reference position of a display region of the screen.

16 Claims, 33 Drawing Sheets

A

B

IMAGE PROCESSING DEVICE, IMAGE PROCESSING METHOD, RECORDING MEDIUM, AND PROGRAM

CROSS-REFERENCE TO RELATED APPLICATION

The present application claims priority from Japanese Patent Application No. JP 2011-125100 filed in the Japanese Patent Office on Jun. 3, 2011, the entire content of which is incorporated herein by reference.

The present disclosure relates to an image processing device, an image processing method, a recording medium, and a program, and particularly to an image processing device, an image processing method, a recording medium, and a program which are capable of observing an image reliably with simple operation.

In the case where a disease of a patient is examined, pathological tissue of the patient is sampled by needle biopsy, mounted onto a prepared glass, and observed under a microscope. However, only one person can carry out the observation under the microscope, and it is inconvenient in the case of making a discussion between multiple doctors.

Accordingly, it is known that an image observed under the microscope is loaded into a computer and is displayed on a display section (for example, JP 2006-228185A). In this way, it becomes possible to scroll and scale the image.

SUMMARY

However, pathological tissue is not necessarily linear. Even if it is linear, there is a case where the direction thereof does not correspond to a scrolling direction. In this case, when the tissue is observed by being scrolled in the vertical direction, for example, the image of the tissue goes out of the screen, and hence, it becomes necessary to additionally perform the scrolling operation in left or right direction. As a result, there was a case where it became difficult to observe the image of the tissue with concentration, distracted by the scrolling operation.

In light of the foregoing, it is desirable to be able to observe the image reliably with simple operation.

According to an aspect of the present technology, there is provided an image processing device which includes a movement section which scrolls a medical image on a screen, and a display control section which, in a case where the medical image is scrolled on the screen, controls a display section to display the medical image in a manner that an observation reference position of a diagnosis region of the medical image passes through a display reference position of a display region of the screen.

The observation reference position may be at a vicinity of a center of a direction perpendicular to a scroll direction of the medical image, and the display reference position may be at a vicinity of a center of the display region.

It may be a case in which scrolling is performed in an automatic mode that the medical image is displayed in a manner that the observation reference position of the diagnosis region passes through the display reference position of the display region of the screen.

In a case where the scrolling in the automatic mode is stopped, scrolling in a manual mode may be performed, and the scrolling in the manual mode may be performed in a direction indicated by a user.

In the case where, after the scrolling in the automatic mode is temporarily stopped, instruction of the scrolling in the automatic mode is issued again in a state where the scrolling in the manual mode is performed in the direction indicated by the user, the scrolling in the automatic mode may be restarted from a position at which the scrolling in the automatic mode is stopped.

The movement section may limit speed of scrolling at an abnormal part in the diagnosis region.

The abnormal part may be highlighted.

The abnormal part may be labelled with a predetermined color.

When reaching an end part of the diagnosis region in a scroll direction, the fact of reaching the end part may be displayed.

The image processing device may further include a detection section which detects the diagnosis region from the medical image.

Grouping of a plurality of the diagnosis regions included in one medical image may be performed, and a diagnosis target image of one group may be scrolled.

The diagnosis region other than an observation target of the medical image may be masked.

The image processing device may further include a scaling section which, when a width in a direction perpendicular to the scroll direction of the diagnosis region is larger than a reduction threshold which is set based on a width of the display region, reduces the width in the direction perpendicular to the scroll direction of the diagnosis region such that the width in the direction perpendicular to the scroll direction of the diagnosis region is smaller than the width of the display region.

When the width in the direction perpendicular to the scroll direction of the diagnosis region is smaller than an enlargement threshold which is set based on the width of the display region, the scaling section may enlarge the width in the direction perpendicular to the scroll direction of the diagnosis region within a range smaller than the width of the display region.

According to another aspect of the present technology, a diagnosis region is detected from a medical image, the medical image is scrolled on a screen, and in a case where the medical image is scrolled on the screen, the medical image is displayed in a manner that an observation reference position of a diagnosis region passes through a display reference position of a display region of the screen.

A method, a recording medium, and a program according to the present technology are a method, a recording medium, and a program each corresponding to the image processing device of an aspect of the present technology described above.

According to the aspects of the present technology described above, an image can be observed reliably with simple operation.

DETAILED DESCRIPTION OF THE EMBODIMENT(S)

Figure 1:
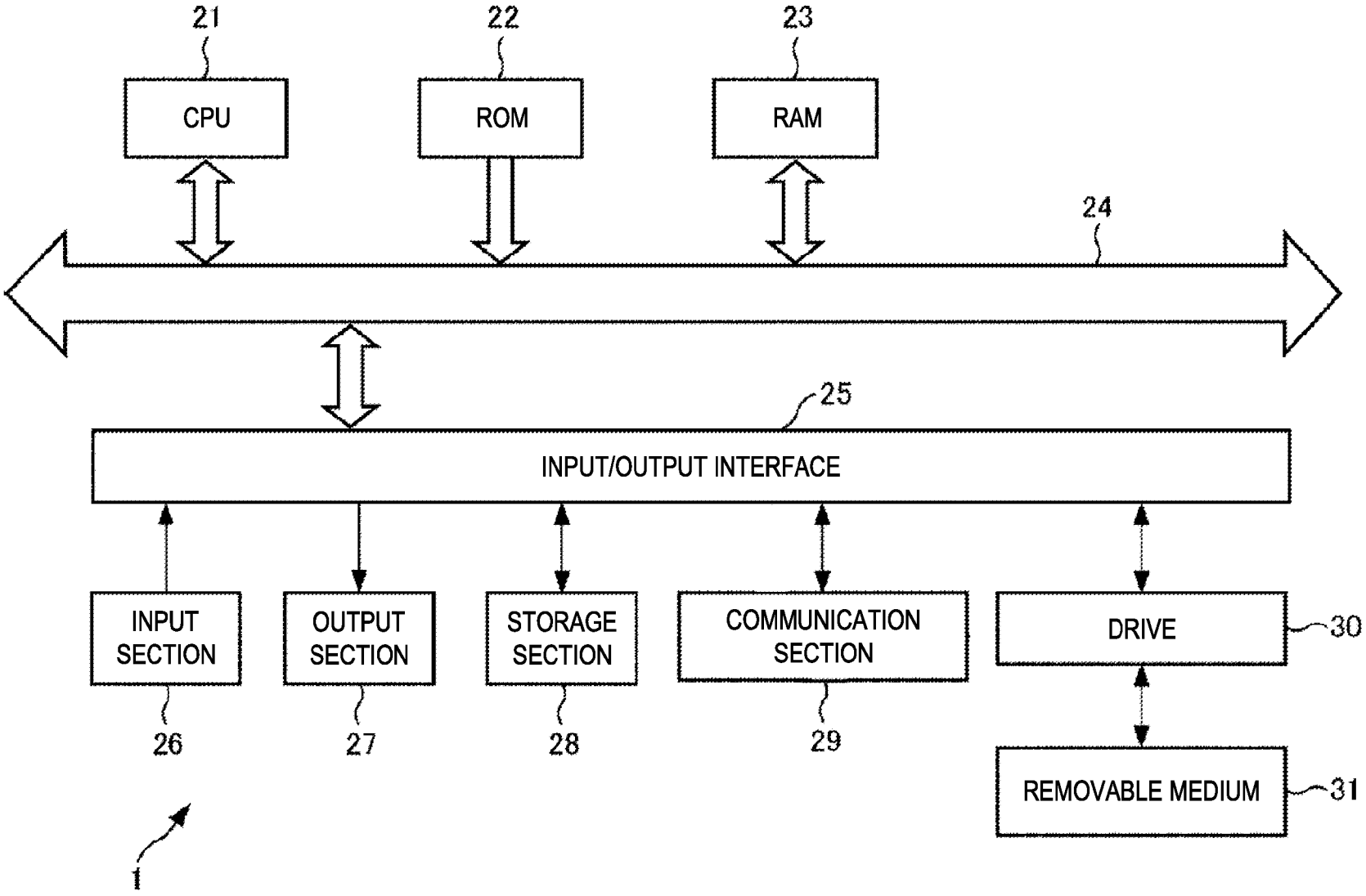
FIG. 1 is a block diagram showing a configuration of an embodiment of an image processing device of the present technology.

Hereinafter, an embodiment for carrying out the technology (hereinafter, referred to as embodiment) will be described. Note that the description will be given in the following order.

1. Configuration of image processing device
2. Display processing
3. Lesion progression label
4. Creation of dictionary
5. Learning method
6. Application of present technology to program
7. Other

[Configuration of Image Processing Device]

FIG. 1 is a block diagram showing a configuration example of an image processing device. An image processing device 1 is configured from a personal computer, for example.

The image processing device 1 includes a CPU (Central Processing Unit) 21, a ROM (Read Only Memory) 22, and a RAM (Random Access Memory) 23, which are connected with one another via a bus 24.

To the bus 24, an input/output interface 25 is connected. Connected to the input/output interface 25 are an input section 26, an output section 27, a storage section 28, a communication section 29, and a drive 30.

The input section 26 includes a keyboard, a mouse, a microphone, and the like. The output section 27 includes a display section, a speaker, and the like. The storage section 28 includes a hard disk, a non-volatile memory, and the like. The communication section 29 includes a network interface and the like. The drive 30 drives a removable medium 31 such as a magnetic disk, an optical disc, a magneto-optical disk, or a semiconductor memory.

In the image processing device 1 configured as described above, the CPU 21 loads a program stored in the storage section 28, for example, into the RAM 23 through the input/output interface 25 and the bus 24 and executes the program, and thereby executing predetermined processing.

In the image processing device 1, for example, the program can be installed in the storage section 28 through the input/output interface 25, by fitting the removable medium 31 as a package medium or the like to the drive 30. Further, the program can be received by the communication section 29 through a wired or wireless transmission medium, and can be installed in the storage section 28. In addition, the program can be installed in the ROM 22 or the storage section 28 in advance.

Figure 2:
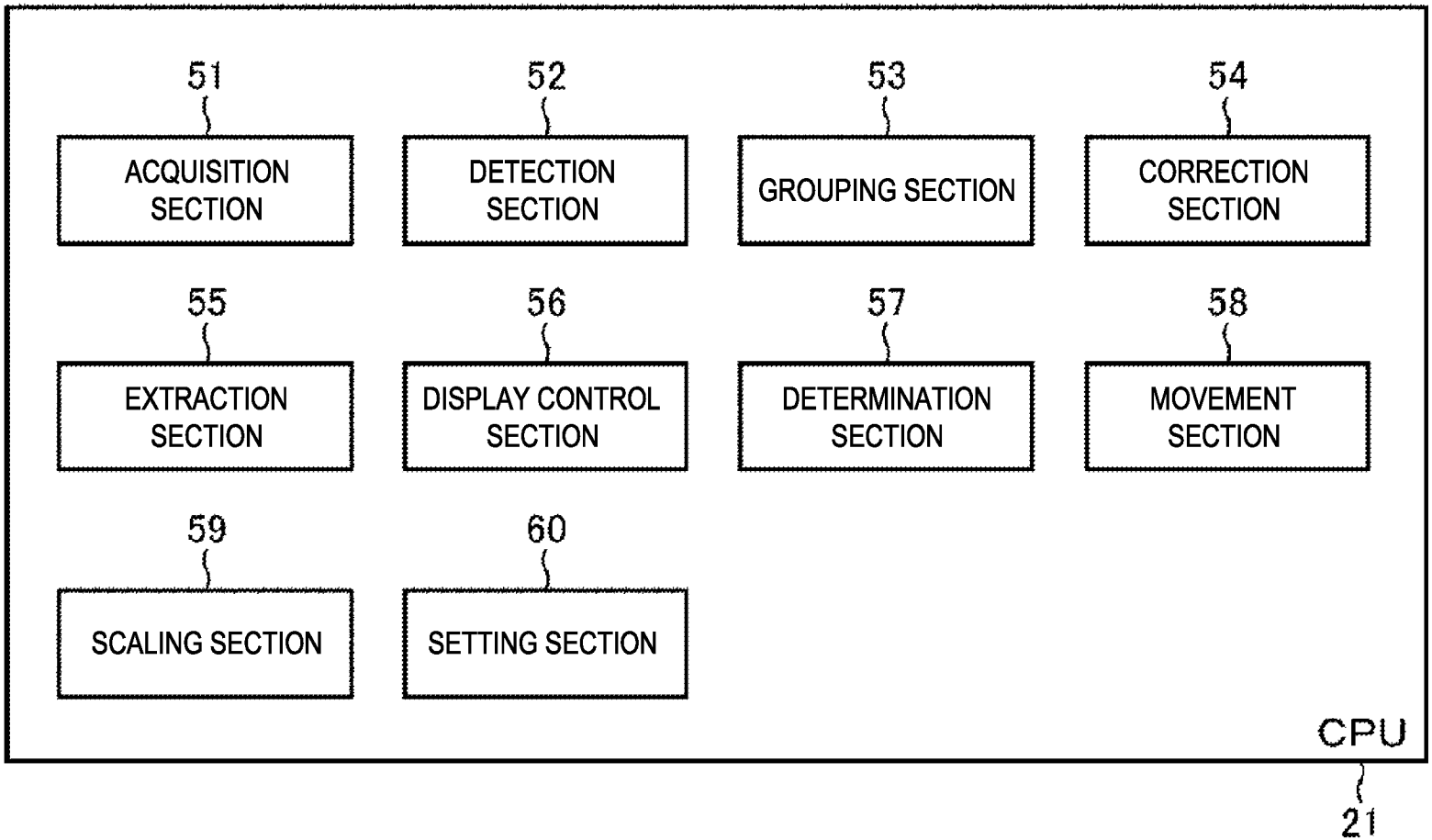
FIG. 2 is a block diagram showing a functional configuration of a CPU.

Next, a functional configuration of the CPU 21 will be described. FIG. 2 is a block diagram showing the functional configuration of the CPU 21. As shown in the diagram, the CPU 21 includes an acquisition section 51, a detection section 52, a grouping section 53, a correction section 54, an extraction section 55, a display control section 56, a determination section 57, a movement section 58, a scaling section 59, and a setting section 60. Each section has a function of transmitting/receiving information as necessary.

The acquisition section 51 acquires various types of information of an image, a mode, and the like. The detection section 52 detects a region. In addition, the detection section 52 identifies a tumor, and also identifies a degree of lesion progression. The grouping section 53 performs grouping of images. The correction section 54 corrects an image. The extraction section 55 extracts a scroll line. The display control section 56 controls a display section to display an image, a predetermined message, or the like. The determination section 57 executes various types of determination processing. The movement section 58 scrolls an image and moves the image to a predetermined position. The scaling section 59 enlarges or reduces an image. The setting section 60 sets a speed.

Figure 3:
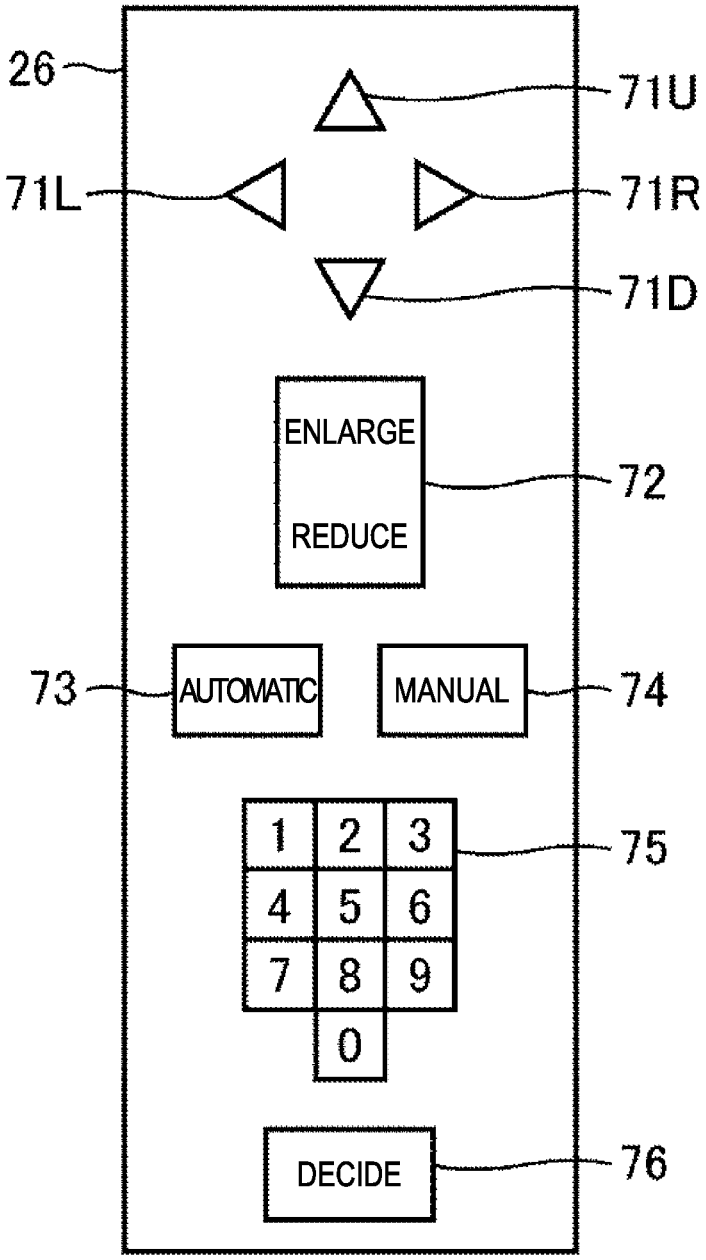
FIG. 3 is a diagram showing a configuration example of an input section.

FIG. 3 is a diagram showing a configuration example of the input section 26. That is, the input section 26 has at least buttons 71U, 71D, 71L, 71R, 72, 73, 74, 75, and 76. The buttons 71U, 71D, 71L, and 71R are operated for moving an image upward, downward, leftward, and rightward, respectively. Note that, in the case where it is not necessary to distinguish the buttons 71U, 71D, 71L, and 71R from one another, they are each simply referred to as button 71. The same is applied to other structural elements. The button 72 is operated upward when enlarging the image, and operated downward when reducing the image. The instructions are issued only while the respective buttons 71 and 72 are being operated, and when the operations are stopped, the respective instructions are terminated.

The button 73 is operated when setting a mode to an automatic mode, and the button 74 is operated when setting the mode to a manual mode. Once the buttons 73 and 74 are operated, the respective instructions are continued even if the operations are released. The button 75 is operated when inputting a numeral such as an image number. The button 76 is operated when determining the choice of image or the like.

[Display Processing]

Next, there will be described display processing executed by the image processing device 1. FIGS. 4 to 8 are each a flowchart illustrating the display processing. The processing is performed for a user such as a doctor to observe a medical image of a patient, for example.

In Step S1, the acquisition section 51 acquires an image. For example, as shown in FIG. 9, in the case where a needle biopsy of a patient is performed, the obtained sample is placed on a prepared glass, and an image obtained by the observation using a microscope is acquired.

Figure 9:
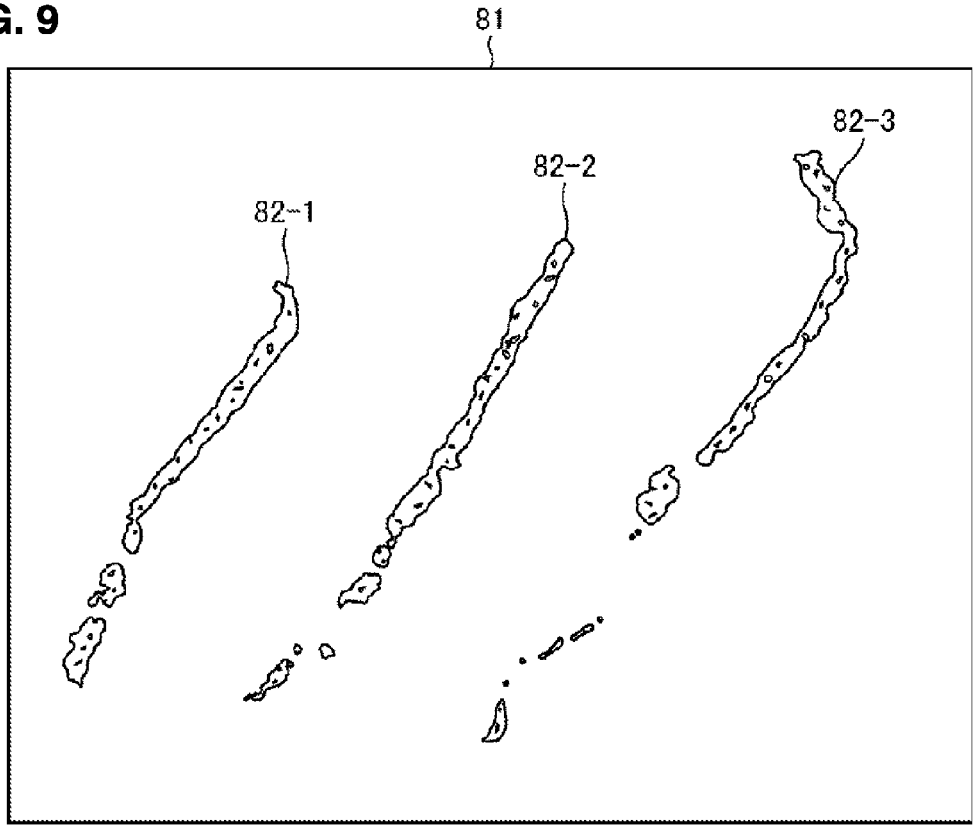
FIG. 9 is a diagram showing an example of an image of a needle biopsy.

FIG. 9 is a diagram showing an example of an image of a needle biopsy. In this example, the needle biopsy is performed three times, and images 82-1 to 82-3, which are cellular tissue samples obtained in the respective needle biopsies, are included in an image 81.

In Step S2, the detection section 52 detects a diagnosis region. For example, the diagnosis region is detected as shown in FIG. 10.

Figure 10:
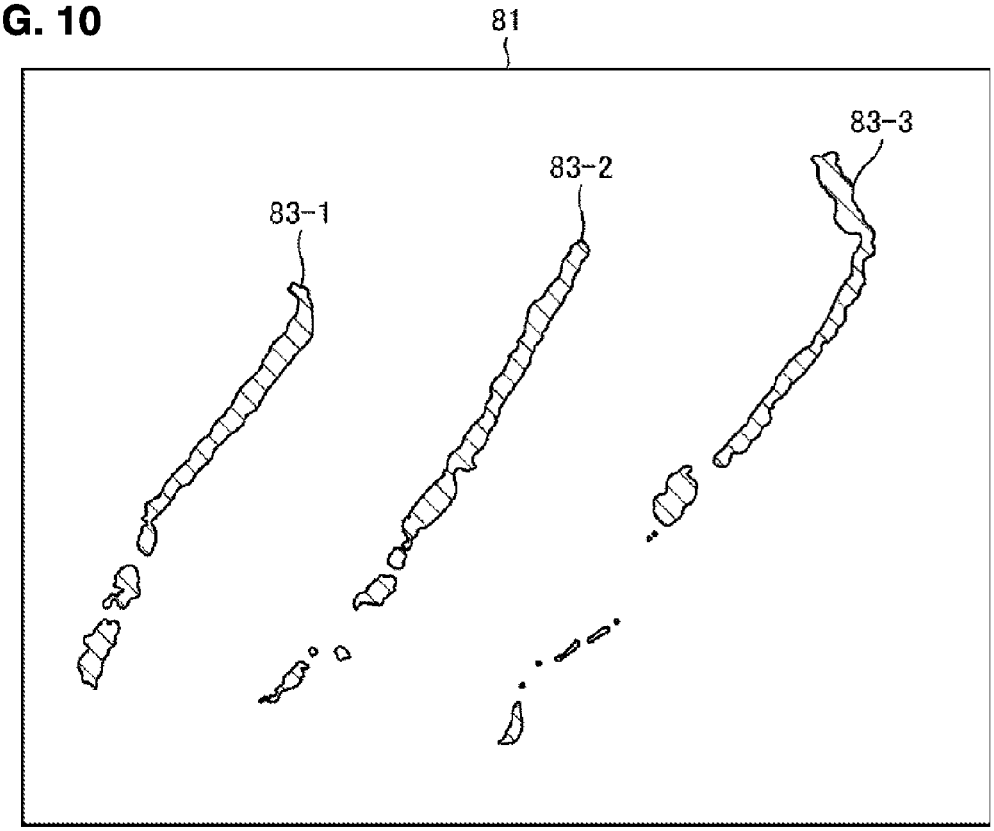
FIG. 10 is a diagram illustrating a diagnosis region.

FIG. 10 is a diagram illustrating a diagnosis region. FIG. 10 shows an example in which the diagnosis region is detected from the image 81 shown in FIG. 9. In the example shown in FIG. 10, regions 83-1 to 83-3 are each detected as a diagnosis region, the regions 83-1 to 83-3 corresponding to the images 82-1 to 82-3, respectively, of the cellular tissue shown in FIG. 9. In other words, by performing the processing, the region other than the images 82-1 to 82-3 of the cellular tissue (that is, the background region) within the image 81 is excluded from the diagnosis region.

In Step S3, the grouping section 53 performs grouping of a plurality of diagnosis regions included in one medical image obtained in the processing of Step S2. In this way, the image of the cellular tissue obtained by needle biopsy each time is provided as a different image. As a result thereof, the following case is prevented from occurring: different cellular tissues are falsely recognized as the same cellular tissues.

The number of groups may be one, or two or more. Since the number represents the number of targets to be scrolled, which is executed in Step S14 to be described later, the number is set to an appropriate value according to the scene of diagnosis. When it is an image of the lungs, since there are two lungs at right and left, the number of groups is set to two, when it is an image of the large intestine, since the number thereof is one, the number of groups is set to one, and in this way, it is preferred to determine the number of groups based on the properties of an object to be diagnosed. In the case of this embodiment, since the number of needle biopsies is three and there are three cellular tissues, the number of groups is set to three.

In the case of performing grouping of a pathology image in terms of the number of biopsies, in general, the number of biopsies is already known at the time of producing the prepared glass, and hence, it is a clustering problem in which the number of clusters is known. Hereinafter, a grouping method using a technique of spectral clustering will be described.

Here, the number of pixels of the diagnosis region is represented by n, and the target number of classes for grouping is represented by C. An affinity matrix Aij is defined as Equation (1), where dij represents the Euclidean distance of coordinate values of a pixel i and a pixel j.

In Equation (1), o represents a scale parameter, and an appropriate value for the object, such as 0.1, is set.

Further, a diagonal matrix D is defined as shown in Equation (2), and a matrix L shown in Equation (3) is operated using Equation (1) and Equation (2).

$$D_{ij} = \sum_{j=1}^{n} A_{ij} \tag{2}$$

$$L = D^{\frac{1}{2}} A D^{\frac{1}{2}} \tag{3}$$

Eigenvectors x1, x2, . . . , xC are determined in descending order of eigenvalue of matrix L, the number of eigenvectors being C, and creates a matrix X shown in Equation (4).

$$X=[x1,x2, \ldots , xC] \tag{4}$$

A matrix Y shown in Equation (5) below, in which the matrix X is normalized for each row, is determined.

$$Y_{ij} = \frac{X_{ij}}{\left(\sum_j X_{ij}^2\right)^{\frac{1}{2}}} \tag{5}$$

When each row in the matrix Y is used as an element vector and subjected to K-means clustering into the number of C, the cluster of the row number i of the matrix Y corresponds to the cluster of the pixel i.

Note that, in the above, the spectral clustering is used, but another clustering technique can be also used by directly applying the K-means method to the input data, for example. It is preferred that an appropriate clustering method be used according to the characteristics of the input data.

Figure 11:
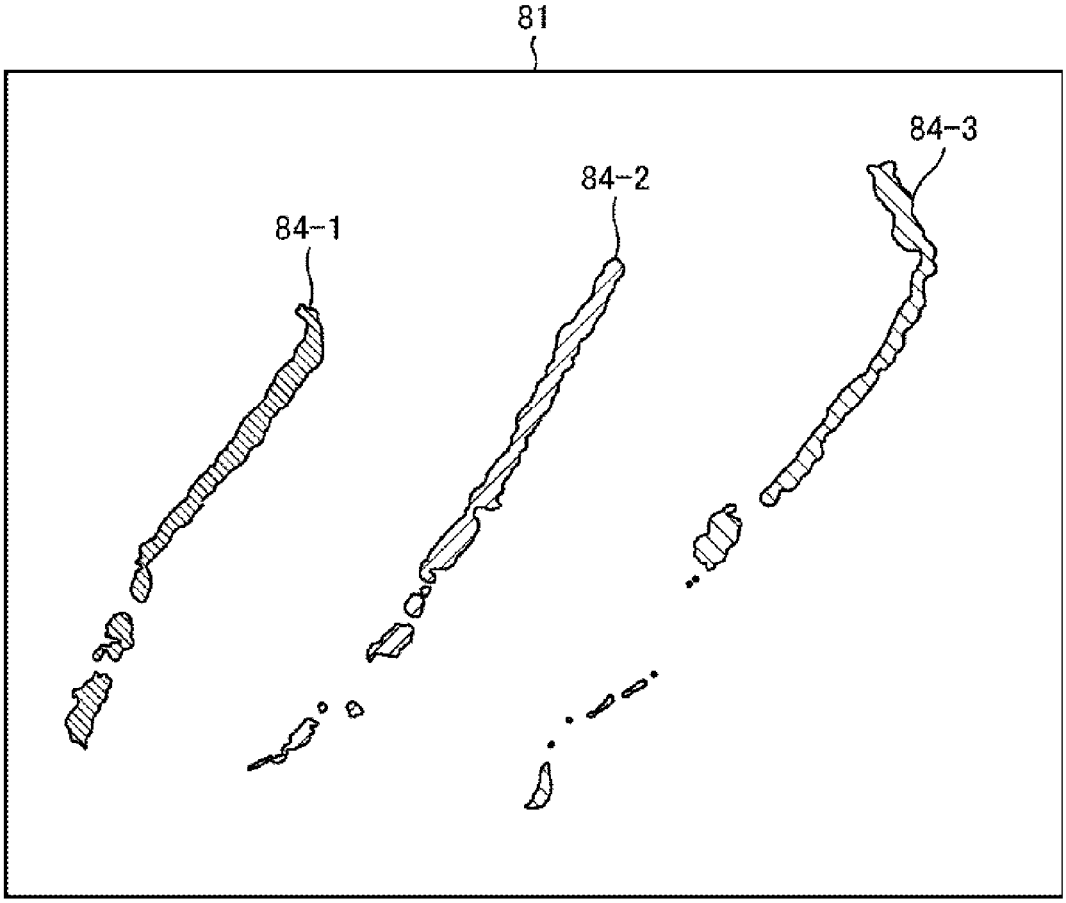
FIG. 11 is a diagram illustrating grouping.

FIG. 11 is a diagram illustrating grouping. FIG. 11 shows a result obtained by performing grouping of the regions 83-1 to 83-3 shown in FIG. 10. In FIG. 11, the regions 83-1 to 83-3 shown in FIG. 10 are grouped into different groups as regions 84-1 to 84-3, respectively.

Figure 12:
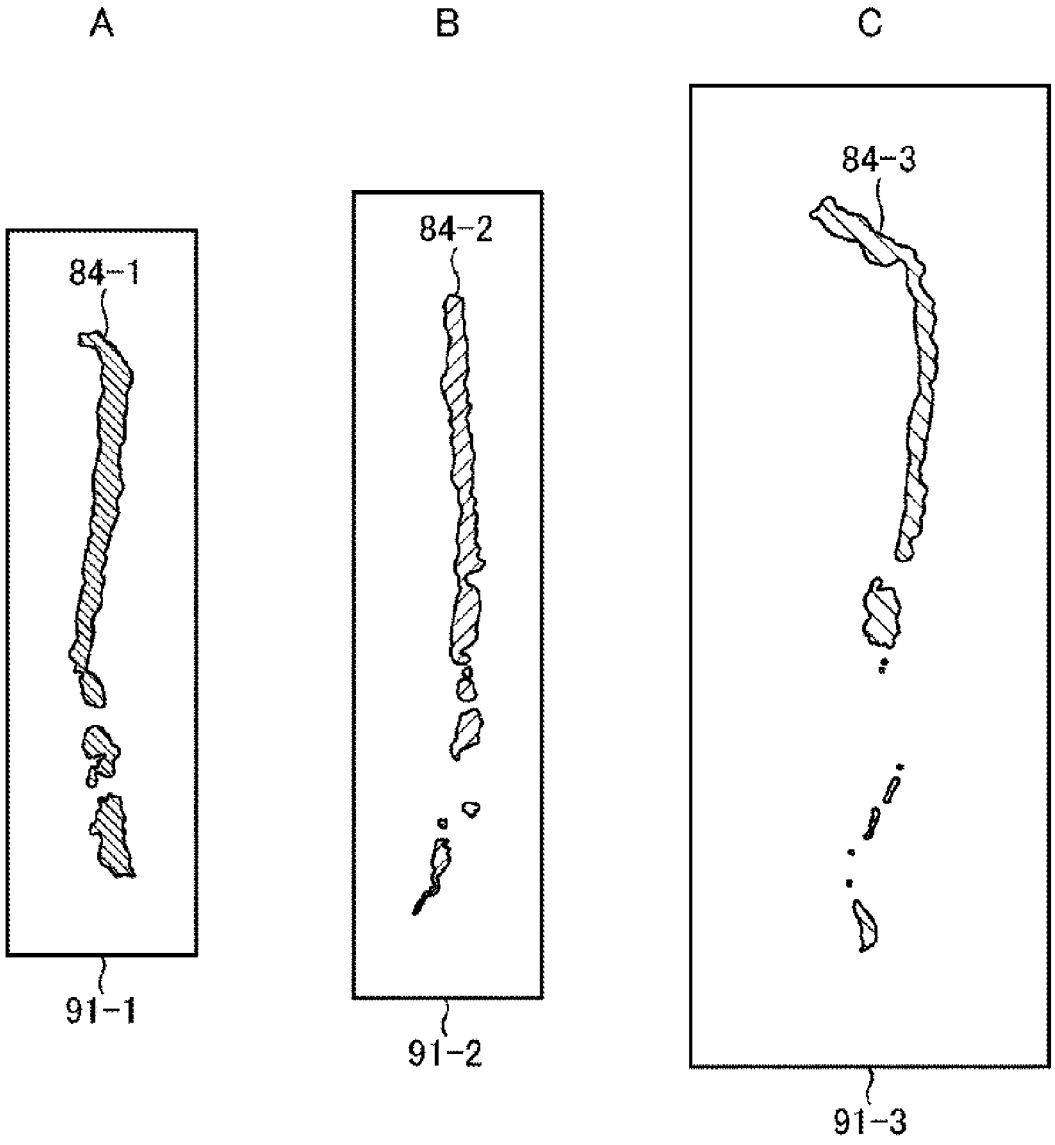
FIG. 12A, FIG. 12B, and FIG. 12C are each a diagram illustrating rotation correction.

In Step S4, as shown in FIG. 12, the correction section 54 performs rotation correction on each region subjected to grouping in Step S3. Specifically, the principal axis of inertia of a region 84 is determined for each group. Each region 84 is subjected to rotation correction such that the principal axis of inertia thereof is parallel to the vertical direction (that is, y-axis direction). A principal axis of inertia θ is represented by Equation (6), where the moment around the center of gravity of the region 84 is represented by upq. In the equation, p represents an order of moment of the x-axis, and q represents an order of moment of the y-axis.

$$\theta = \frac{1}{2}\tan^{-1}\left(\frac{2u_{11}}{u_{20} - u_{02}}\right) \tag{6}$$

FIG. 12A, FIG. 12B, and FIG. 12C are each a diagram illustrating rotation correction. In the examples shown in FIG. 12A, FIG. 12B, and FIG. 12C, the image including the region 84-1, which is put into one group in the processing of Step S3, is set as an image 91-1. In the same manner, the image including the region 84-2, which is put into another group, is set as an image 91-2, and the image including the region 84-3, which is put into still another group, is set as an image 91-3. The regions 84-1 to 84-3 are arranged such that the principal axes of inertia thereof are in the vertical direction, inside the images 91-1 to 91-3, respectively.

In Step S5, the extraction section 55 extracts a scroll line. The scroll line is extracted for each group generated by the processing performed in Step S3. That is, the centers in the horizontal direction of each of the regions 84-1 to 84-3 subjected to rotation correction are connected with a line, and thereby obtaining the scroll line.

Note that the above processing may be executed by another device. In this case, the image processing device 1 acquires image data and metadata indicating the scroll line thereof.

Figure 13:
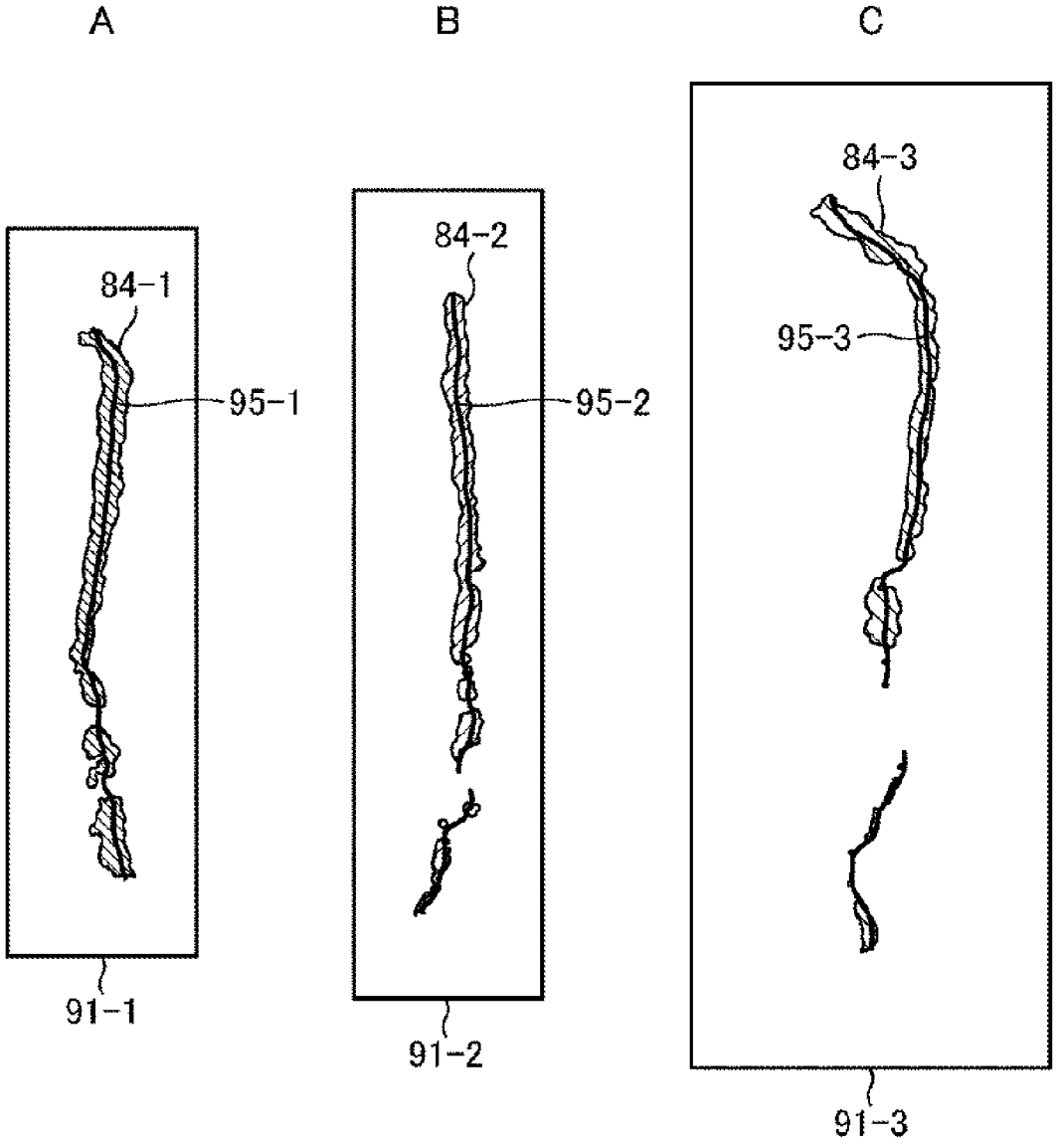
FIG. 13A, FIG. 13B, and FIG. 13C are each a diagram illustrating a scroll line.

FIG. 13A, FIG. 13B, and FIG. 13C are each a diagram illustrating a scroll line. In FIG. 13A, FIG. 13B, and FIG. 13C, scroll lines 95-1 to 95-3 are shown in the regions 84-1 to 84-3, respectively.

Note that it is not necessarily necessary to perform rotation correction in order to determine the scroll line 95. For example, the scroll line 95 can be also determined by performing linearization processing of a binary image.

Next, the user causes the image acquired as described above to be displayed on the display section that forms the output section 27, and observes the image.

Accordingly, the user operates the button 75 to input an image number, thereby selecting the image to observe. For example, in the case where there are three images, the number that corresponds to the image to be observed among them is input. In addition, the user determines the choice of image by operating the button 76. In the case where the number of images is one, only the operation of the button 76 is performed.

When the button 76 is operated, in Step S6, the acquisition section 51 acquires an image. For example, among the three images of the images 91-1 to 91-3, the image 91-1, the number specified by the user, is acquired.

In Step S7, the display control section 56 controls a display section to display the image. That is, the image acquired in Step S6 is displayed on a display section 101 that forms the output section 27, as shown in FIG. 14.

Figure 14:
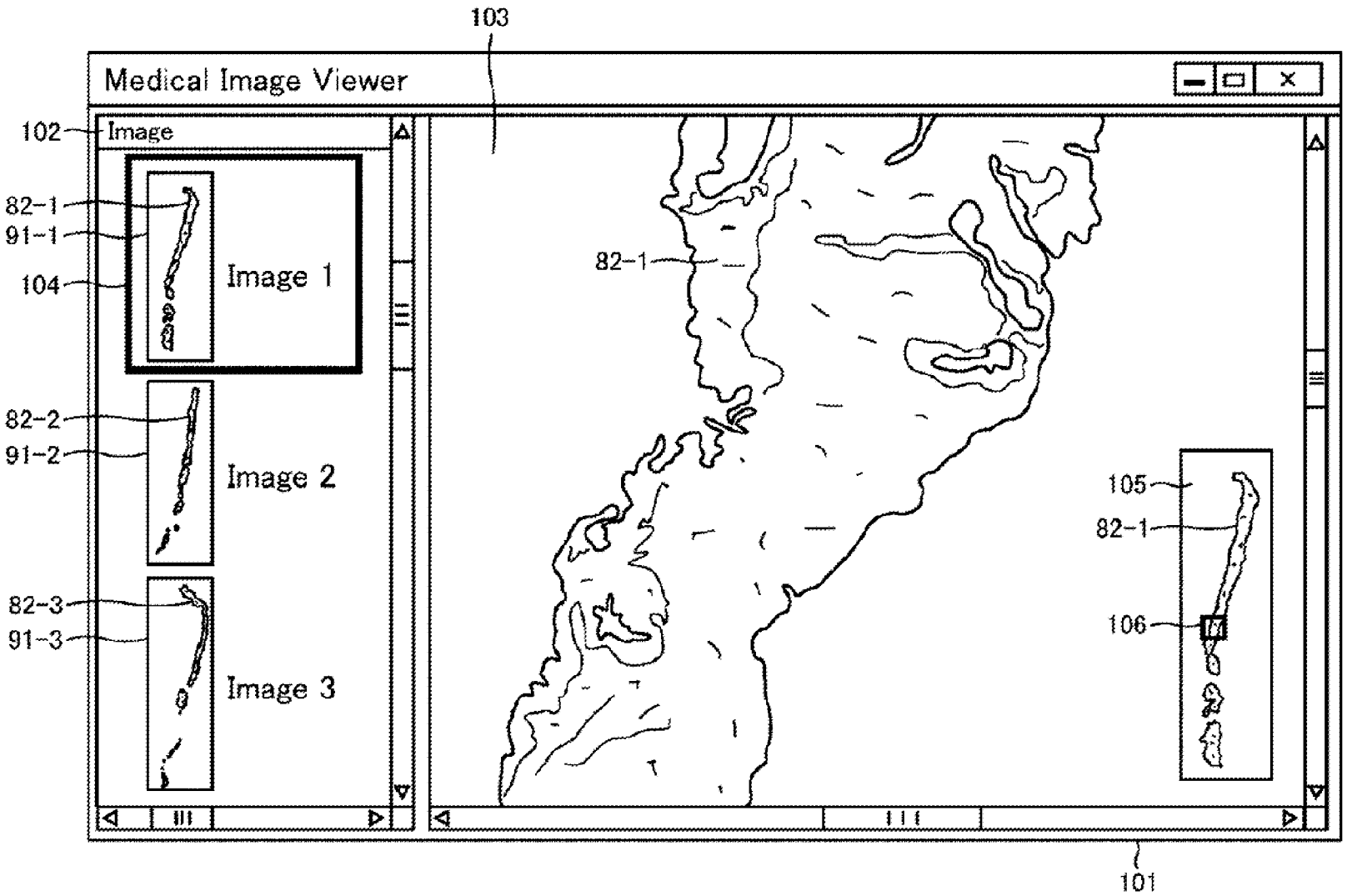
FIG. 14 is a diagram illustrating a display example of a pathology image.

FIG. 14 is a diagram illustrating a display example of a pathology image. In the display example shown in FIG. 14, a region 102, which occupies about one-quarter on the left side of the display section 101, displays thumbnails of the acquired images 91-1 to 91-3. A region 103, which occupies about three-quarters on the right side of the display section 101, displays the image corresponding to the selected thumbnail. The user moves a cursor 104 displayed on the region 102 up and down by operating the buttons 71U and 71D, and selects a desired image. In the example shown in FIG. 14, since the cursor 104 is placed on the image 91-1, the image 91-1 including the image 82-1 is displayed on the region 103. Note that the scroll line 95 is an imaginary line, and is not actually displayed on the region 103.

Further, on a region 105 at bottom-right of the region 103, there is displayed an image in order for the user to easily identify the position of the image displayed in the region 103, among the whole. In the example shown in FIG. 14, a marker 106 is displayed at the position corresponding to the current display position on the thumbnail of the image 82-1.

Note that, in the example shown in FIG. 14, three images of the images 91-1 to 91-3 are displayed in the region 102, but in the case where there are four or more images, the button 71D is further operated in the state in which the cursor 104 is placed at the bottommost side. In this way, the thumbnails are scrolled upward, and the fourth and the following images are displayed sequentially.

Figure 15:
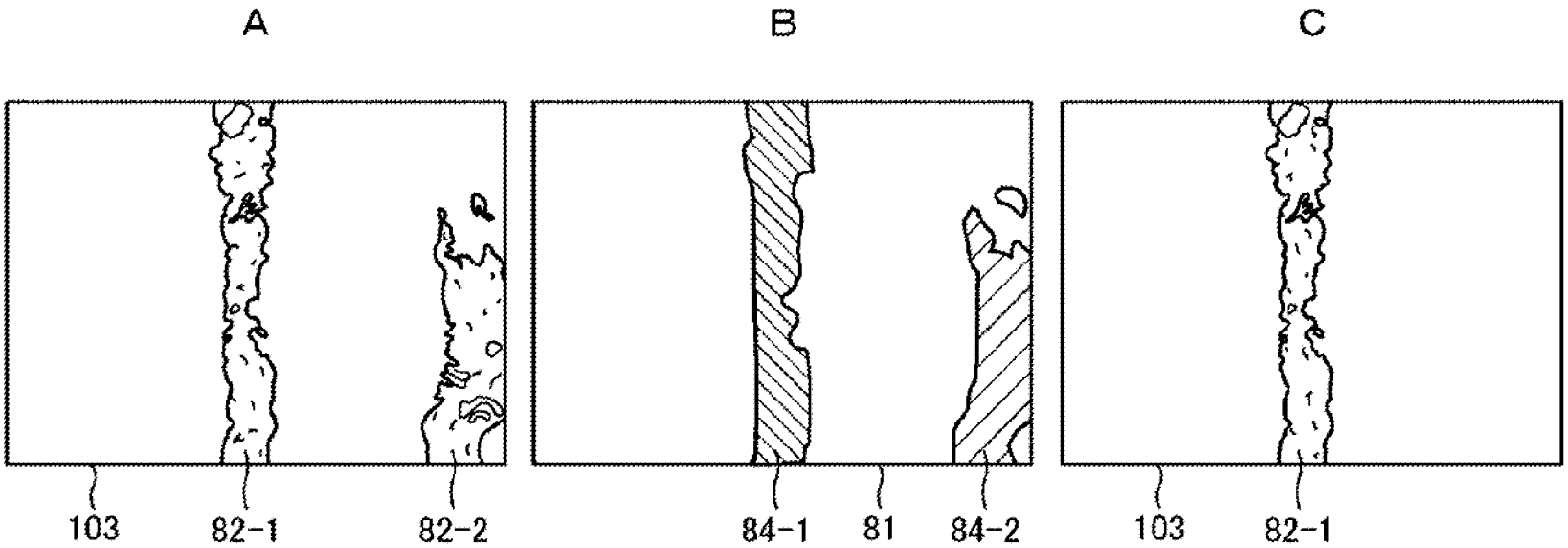
FIG. 15A, FIG. 15B, and FIG. 15C are each a diagram illustrating masking.

Note that when the plurality of images 82-1 to 82-3 of cellular tissues are close to each other, there is a risk that, as shown in FIG. 15, a part of another image which is grouped into different group may simultaneously displayed along with images of the each group.

FIG. 15A, FIG. 15B, and FIG. 15C are each a diagram illustrating masking. In the example shown in FIG. 15A, there is displayed the image 82-2 on the right hand side of the image 82-1 of the cellular tissue. If the image as shown in FIG. 15A is displayed in the case of displaying the image 82-1, there is a risk that the user may falsely recognize the image 82-2 as the image of a part of the image 82-1.

As shown in FIG. 15B, by performing the grouping processing of Step S3, the region 84-2 of the image 82-2 is detected as a different region (that is, different group) from the region 84-1 of the image 82-1. Based on the detection result, as shown in FIG. 15C, when the image 82-1 is to be displayed, the other image 82-2 is masked and is not displayed. In this way, the user can reliably observe one image. As a result thereof, even in the case where the image 82-1 and the image 82-2 are the images of needle biopsy from different patients, for example, the following case is prevented from occurring: a wrong determination is made to a patient based on the other patient's image.

In Step S8, an acquisition section 61 acquires a mode. That is, the user operates the button 73, 74, and a set mode is acquired.

In the case where the user operates the button 73 and the automatic mode is set, the image is scrolled in the direction from down to up at a fixed speed while the button 71U is being operated. Further, while the button 71D is being operated, the image is scrolled in the direction from up to down at a fixed speed.

On the other hand, in the case where the user operates the button 74 and the manual mode is set, the image is scrolled upward or downward while the button 71U or the button 71D is being operated, and the speed thereof varies depending on the force of pressing the button 71U, 71D. With the increase in the pressing force, the speed increases, and with the decrease in the pressing force, the speed decreases.

In Step S9, the determination section 57 determines whether the scroll mode acquired in Step S208 is the automatic mode.

In the case where the automatic mode is set, the determination section 57 determines in Step S10 whether the instruction of the upward or downward scrolling is issued. That is, when the user wants to start scrolling, the user operates the button 71U, 71D. In the case of issuing the instruction of scrolling upward, the button 71U is operated, and in the case of issuing the instruction of scrolling downward, the button 71D is operated. In the case where the button 71U or the button 71D is operated, it is determined that the instruction of the upward or downward scrolling is issued.

In the automatic mode, only the buttons 71U and 71D are operable, and in the case where none of those buttons is operated, the processing returns to Step S9. Until the button 71U, 71D is operated, the processing of Steps S9 and S10 is repeated.

In the case where the instruction of the upward or downward scrolling is issued, the movement section 58 moves a display position to a scroll stop position in Step S11.

That is, in the case of this embodiment, when the automatic mode is set, the image is scrolled such that the scroll line 95 is at the center of the screen. That is, an observation reference position in observing an image by scrolling the image is set as the center of the direction perpendicular to the scroll direction of the image, that is, the scroll line 95. Then, a display reference position in displaying an image to be scrolled is set as the center of a display region. Of course, it is not necessary that the center used herein is actually an accurate center, and the center may be within the vicinity of the center.

However, as will be described later, when the upward or downward scrolling is stopped once and the leftward or rightward scrolling is performed in the manual mode, there occurs a state where the scroll line 95 is not at the center of the screen. Accordingly, in such as case, the movement section 58 moves the image to the scroll stop position. In this way, the observation failure is prevented from occurring. Note that in the case where the scrolling in the manual mode is not executed at all, since the display position stays at the stop position, the processing is substantially not executed.

Figure 7:
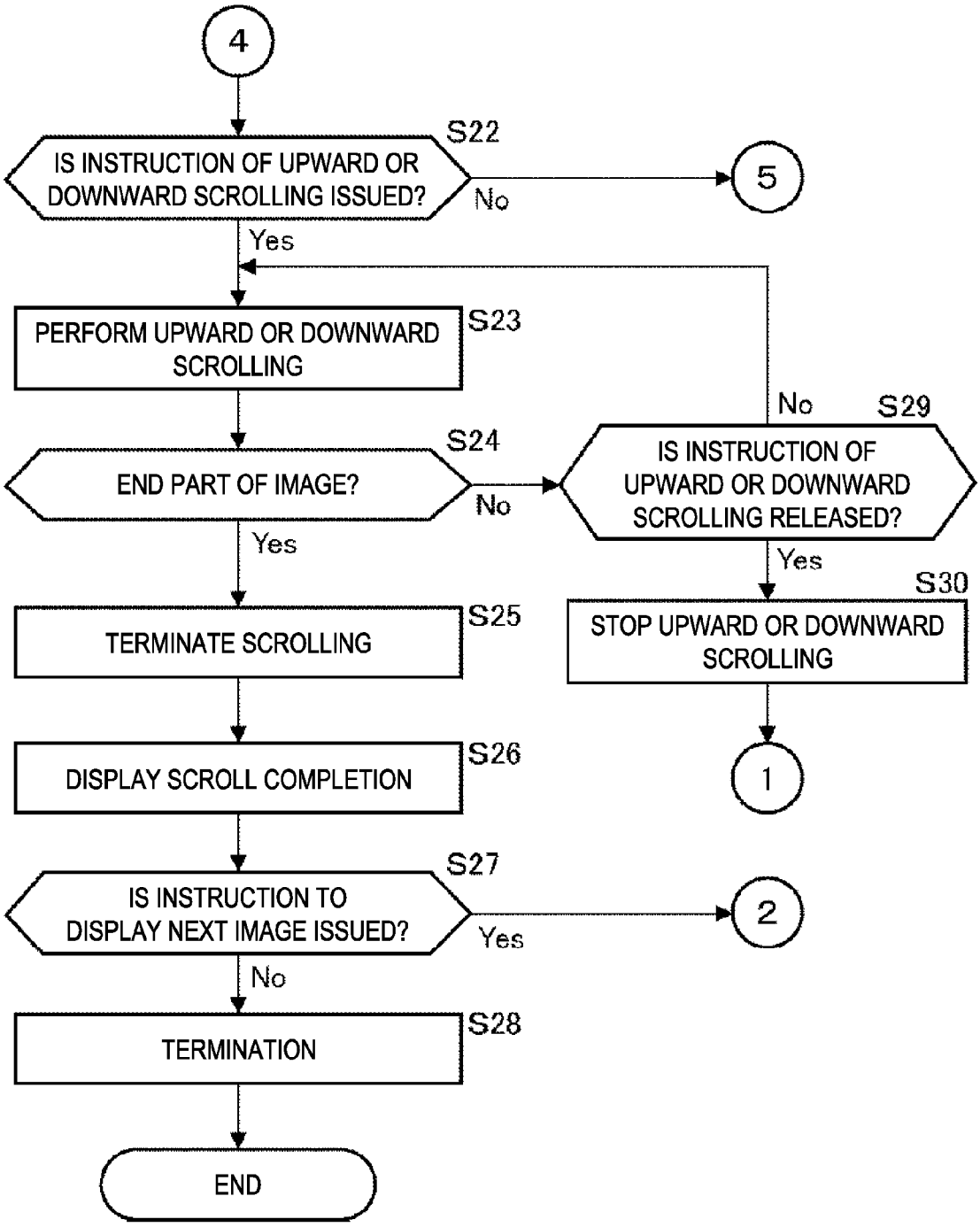
FIG. 7 is a flowchart illustrating the display processing.
Figure 16:
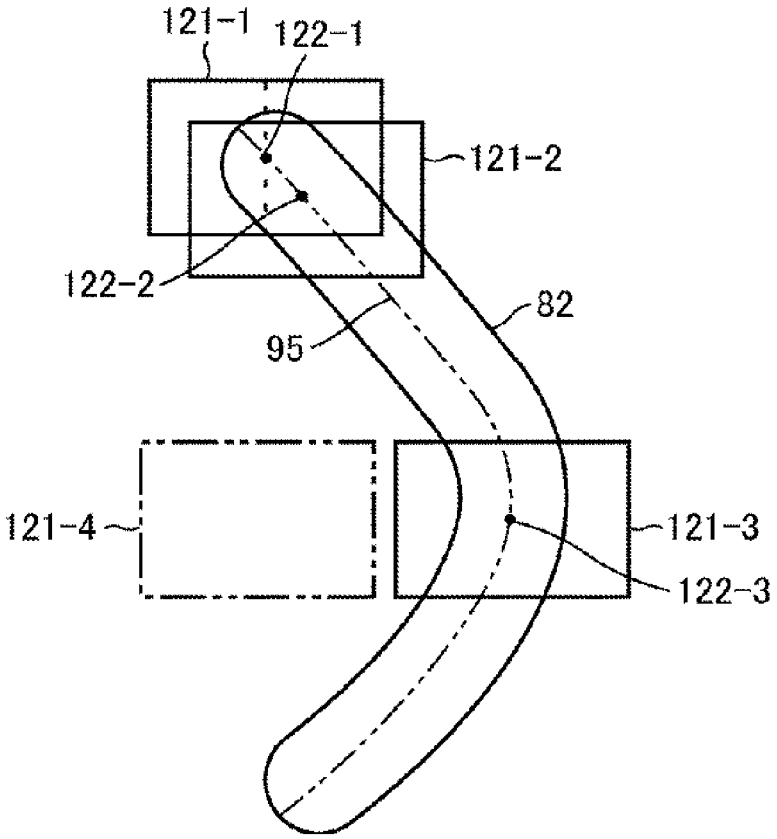
FIG. 16 is a diagram illustrating scrolling.
Figure 17:
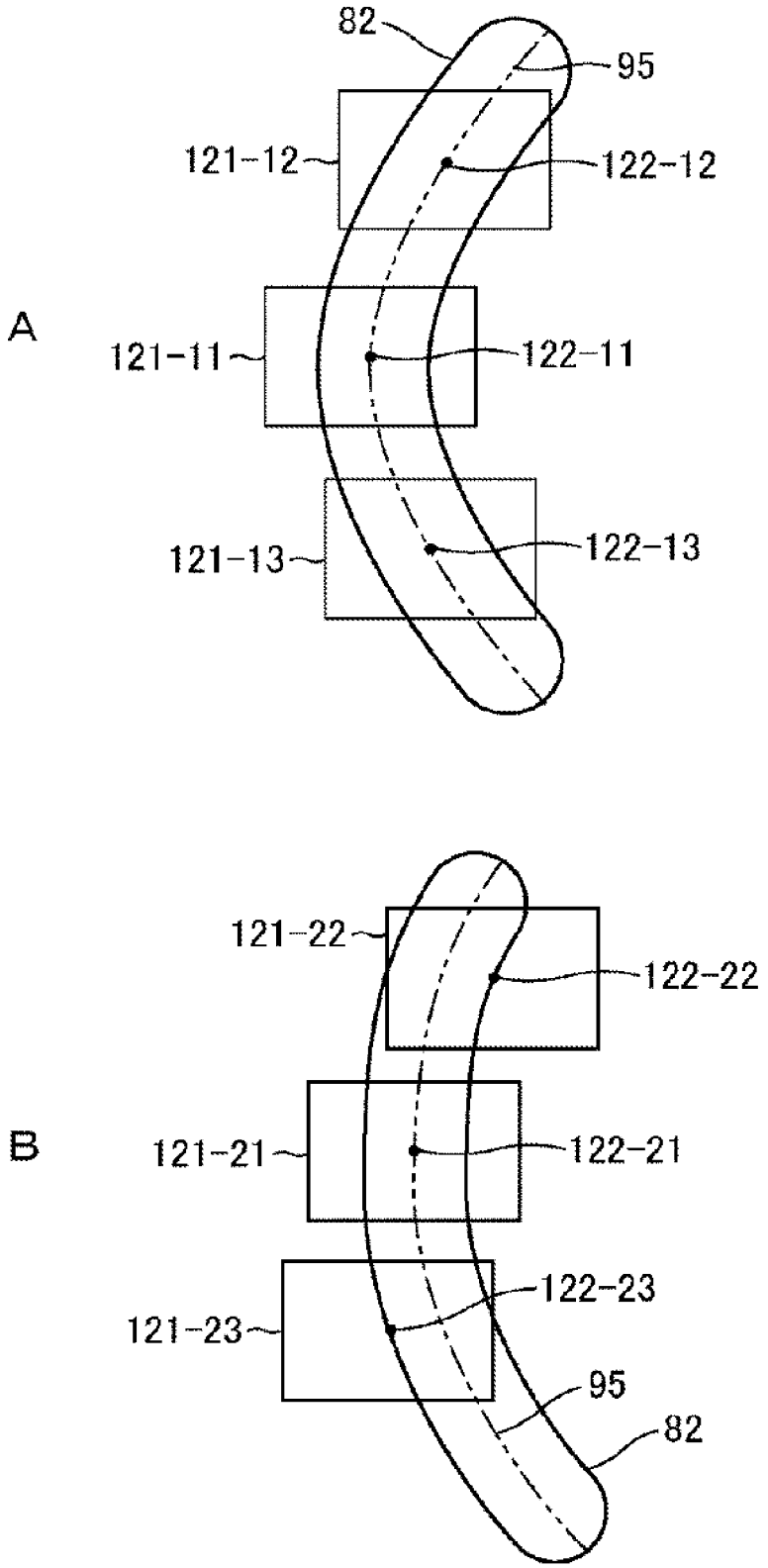
FIG. 17A and FIG. 17B are each a diagram illustrating scrolling.
Figure 18:
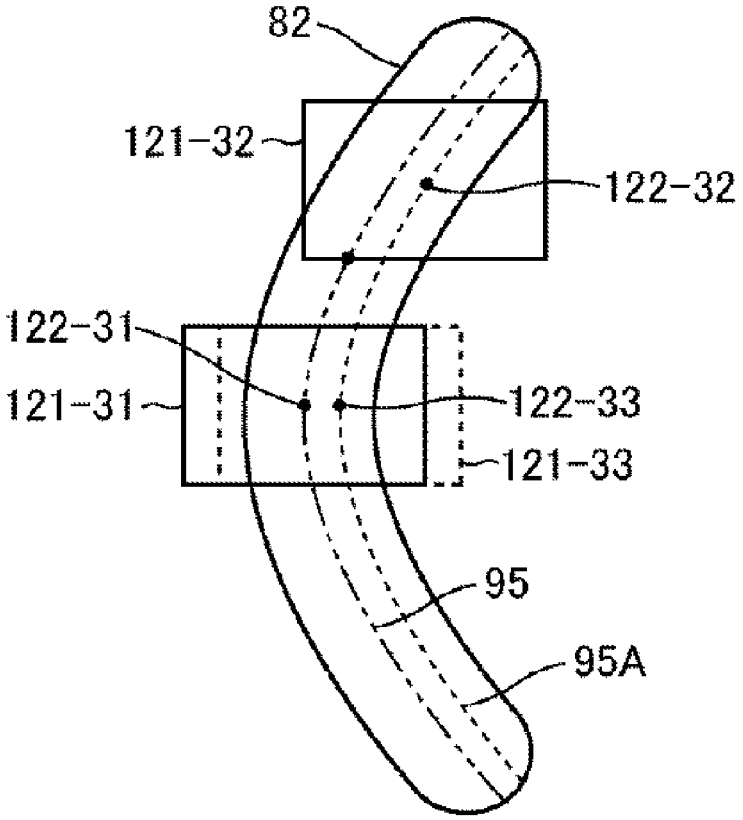
FIG. 18 is a diagram illustrating scrolling.

Here, with reference to FIGS. 16 to 18, there will be described the movement of the image in the case where the scrolling in the manual mode is performed (that is, in the case where the processing from Steps S22 to S30 of FIG. 7 to be described later is executed). FIGS. 16 to 18 are each a diagram illustrating scrolling.

In FIG. 16, the screen 121 is a region displaying the image 82 of the display section 101, and corresponds to the region 103 of FIG. 14. In the present embodiment, the image 82 is scrolled such that the scroll line 95 is at the center 122 of the screen 121. In the case where the instruction of the upward scrolling is issued, the lower parts of the image 82 are gradually displayed as shown in screens 121-1, 121-2, and 121-3. Note that, as described above, the scroll line 95 of the image 82 is an imaginary line, and is not actually displayed.

In any of the screens 121-1, 121-2, and 121-3, the scroll line 95 is on the centers 122-1, 122-2, and 122-3 thereof. That is, in the case of an ordinary device, when the instruction of scrolling upward from the position of the screen 121-1 is issued, for example, the image at the position of the screen 121-4 is displayed. Since the image 82 is curved, the image 82 is not displayed in the screen 121-4, and only the background is displayed. In this case, unless the user operates the button 71L and scrolls the image 82 in the left direction, it is difficult for the user to observe the image 82. However, according to the present technology, the user is only to operate the downward button 71D, and the image 82 is displayed within the screen 121 at all times, and thus, the operability is satisfactory.

Further, as shown in FIG. 17A, let us assume that the downward scrolling in the automatic mode is temporarily stopped at the position of a screen 121-11. In addition, let us assume that the button 74 is operated and the mode is switched from the automatic mode to the manual mode, the button 71 is operated and the screen is scrolled, and the display position reaches the position of a screen 121-12 or a screen 121-13. In the screen 121-12, 121-13, the scroll line 95 is at a center 122-12, 122-13.

In this state, when the button 73 is operated again and the automatic mode is set, and then the button 71U is operated, the image 82 is moved from the position of the screen 121-12 or the screen 121-13 to the position of the screen 122-11 at which the automatic scrolling is stopped, and the scrolling in the automatic mode is restarted from there.

In addition, as shown in FIG. 17B, let us assume that the scrolling in the automatic mode is temporarily stopped at the position of a screen 121-21, and after that, the display position of the image 82 is moved in the manual mode to the position of a screen 121-22 or a screen 121-23. At position of the screen 121-22, 121-23, the scroll line 95 is not at a center 122-22, 122-23 of the screen. In the case where the instruction of scrolling in the automatic mode is issued again in this state, the display position is moved from the position of the screen 121-22 or the screen 121-23 to the position of the screen 121-21, and the automatic scrolling is restarted from there.

For example, when the automatic scrolling is restarted from the position of the screen 121-13 (or screen 121-23), the image 82 between the screen 121-13 (or screen 121-23) and the screen 121-11 (or screen 121-21) is not displayed. Accordingly, in the present technology, the automatic scrolling is restarted from the stop position.

In the above, in the case where the automatic scrolling, which is temporarily stopped, is restarted, the automatic scrolling is performed along the scroll line 95. However, in the case where the instruction of restart is issued, the automatic scrolling can be also performed along an imaginary line 95A, which is parallel to the scroll line 95, as shown in FIG. 18 for example. In the example shown in FIG. 18, after the automatic scrolling is temporarily stopped at the position of a screen 121-31, the image 82 is manually scrolled to the position of a screen 121-32.

In the case where the instruction of restart of the automatic scrolling is issued in this state, a line 95A (the line shown in the dotted line in FIG. 18), which is parallel to the scroll line 95 that passes through a center 122-32 of the screen 121-32, is calculated. Then the automatic scrolling is executed along the line 95A. As a result thereof, on a screen 121-33, for example, the line 95A is arranged on a center 122-33 of the screen 121-33.

Figure 5:
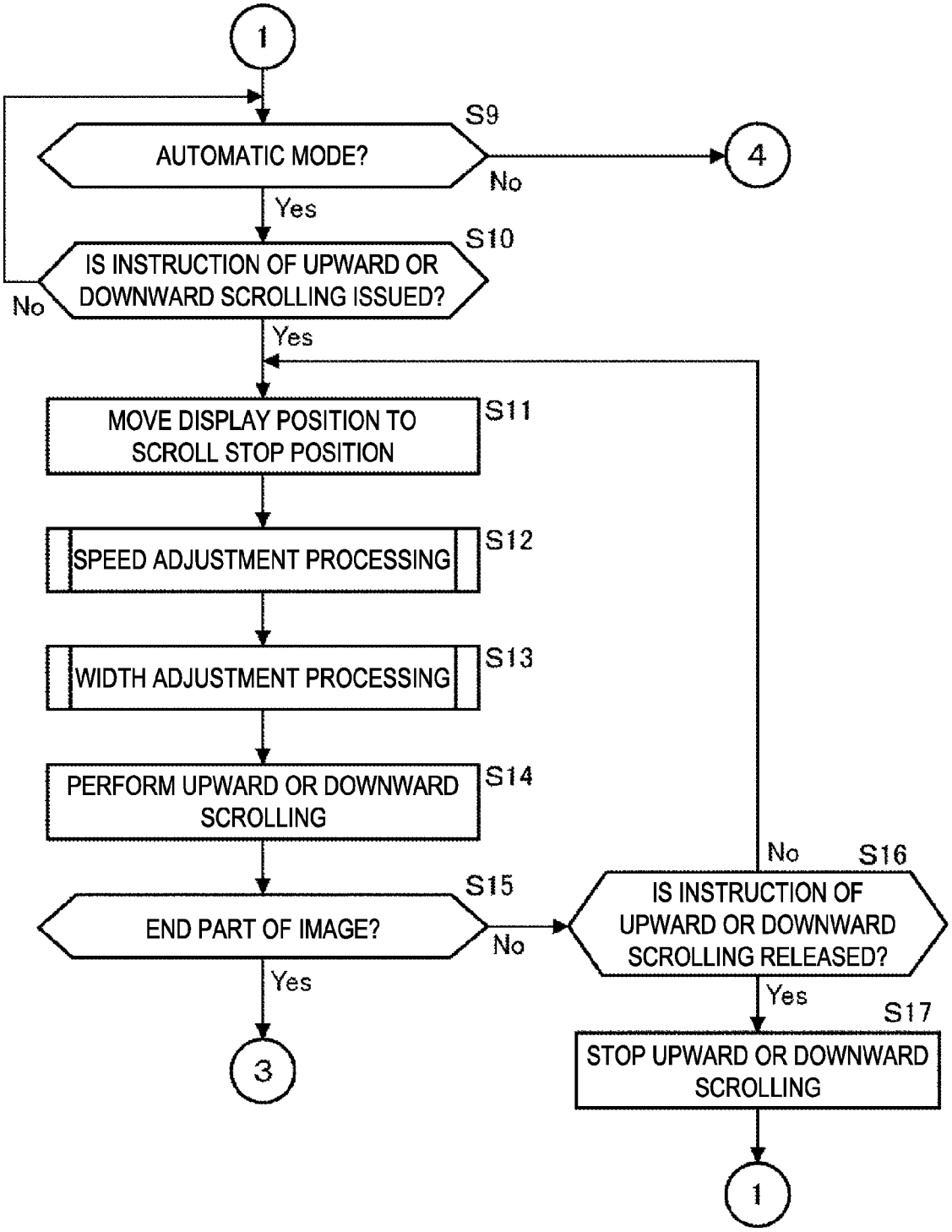
FIG. 5 is a flowchart illustrating the display processing.

Back to the description of FIG. 5, after the processing of moving the display position to the scroll stop position is performed in Step S11 as described above, speed adjustment processing is executed in Step S12. The speed adjustment processing will be described with reference to FIG. 19.

Figure 19:
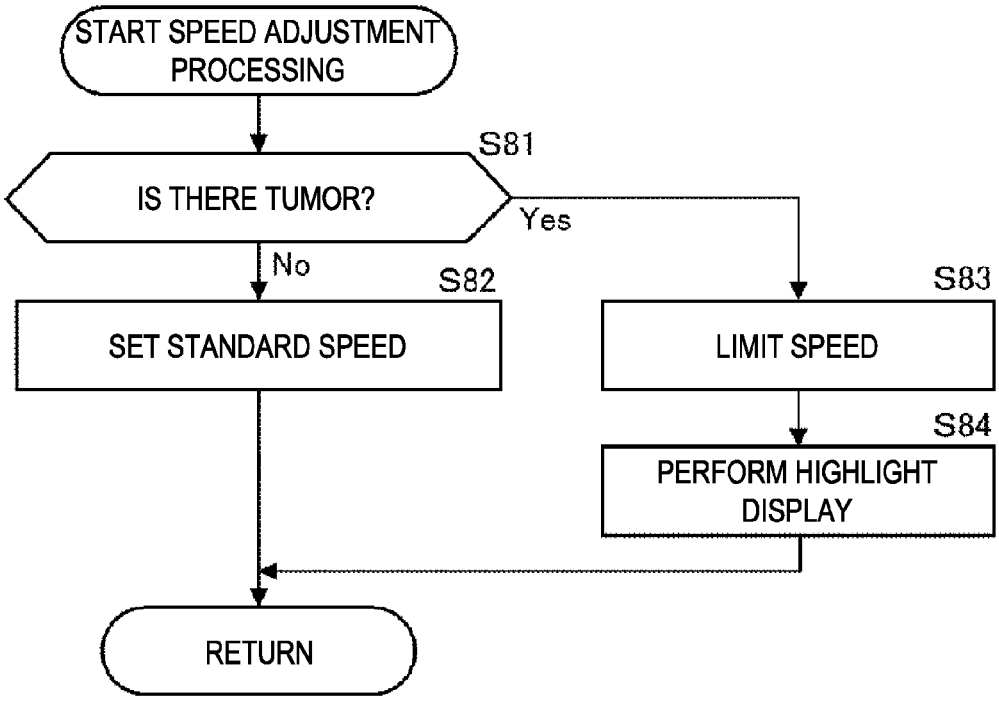
FIG. 19 is a flowchart illustrating speed adjustment processing.

FIG. 19 is a flowchart illustrating speed adjustment processing. In Step S81, the determination section 57 determines whether there is a tumor. That is, whether there is a tumor in the image 82 displayed in the region 103 of the display section 101 is determined. In the case where there is no tumor, the movement section 58 sets a standard speed as the speed for the automatic scrolling in Step S82.

On the contrary, in the case where there is an abnormal part, that is, a tumor, the movement section 58 limits the scroll speed in Step S83. For example, there is set a confirmation speed as the speed for automatic scrolling. The confirmation speed is slower than the standard speed set in Step S82. In this way, in the case where there is a tumor, the user can more easily identify the presence of the tumor. Further, in the case where there is no tumor, since the scroll speed does not become slow, the image can be confirmed quickly. Further, in the case where there is a tumor, the scrolling can also be stopped.

In addition, in Step S84, the display control section 56 controls a display section to highlight the tumor part in the image. That is, the detection section 52 identifies a tumor that is present within the image 82, and when the tumor is identified, the part is highlighted. In this way, the user can further reliably confirm the presence of the tumor.

FIG. 20A and FIG. 20B are each a diagram showing an example of highlighting. In the case where there is no tumor, the image 82-1 is displayed as it is, as shown in FIG. 20A. On the contrary, in the case where there is a tumor, the position of the tumor is highlighted as shown in FIG. 20B. In this example, the part which is determined as a tumor is displayed by being surrounded by a line 151 with a loud color (for example, colors such as yellow and red). In addition thereto, the tumor part can also be highlighted by performing enlarged display.

Back to the description of FIG. 5, after the speed adjustment processing is performed in Step S12, width adjustment processing is executed in Step S13. The width adjustment processing will be described with reference to FIG. 21.

Figure 21:
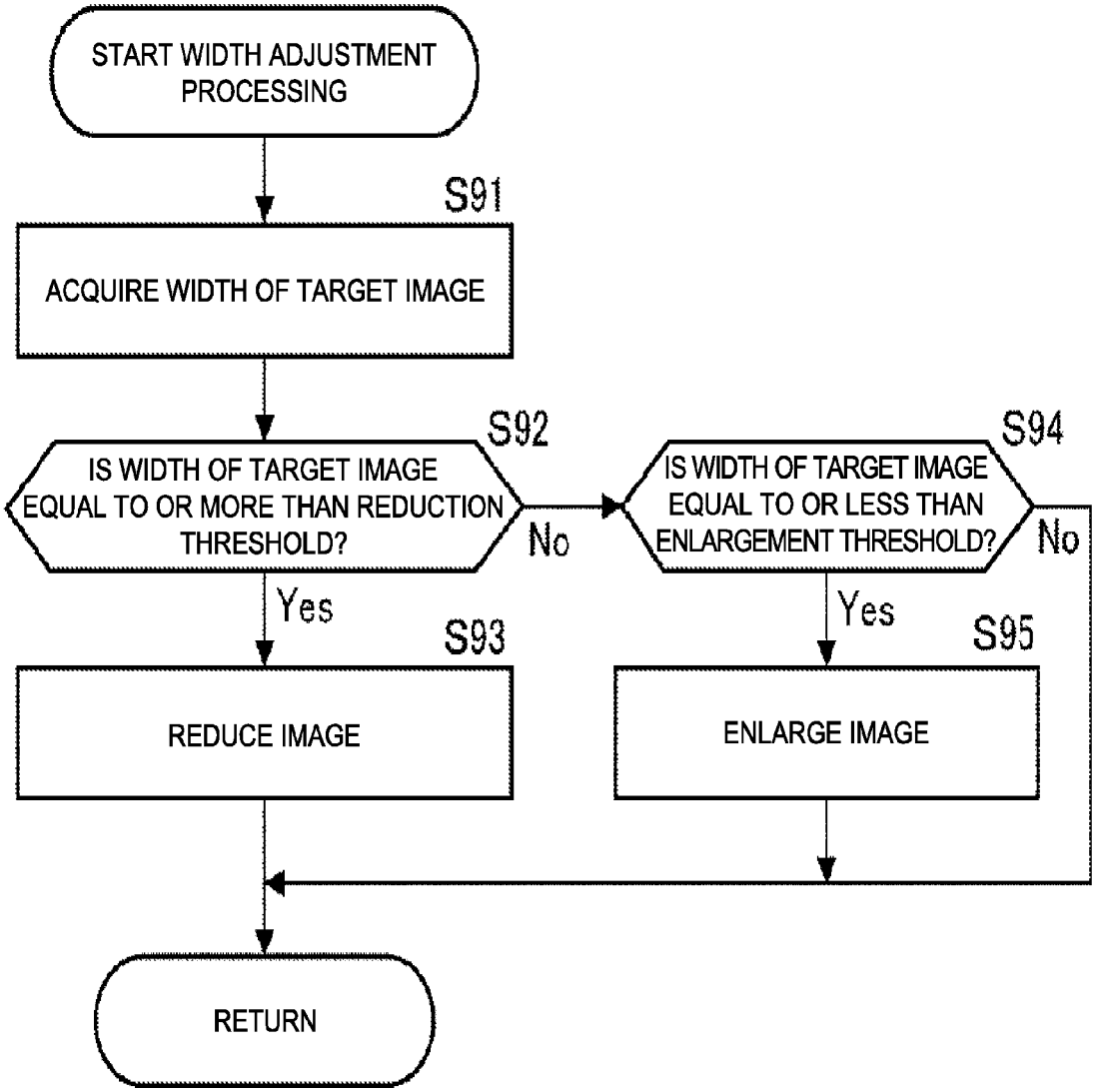
FIG. 21 is a flowchart illustrating width adjustment processing.

FIG. 21 is a flowchart illustrating width adjustment processing. In Step S91, the acquisition section 51 acquires the width of a target image. The target image is an image of a diagnosis region displayed in the region 103 of the display section 101, that is, the image 82, and the width in the case where the image 82 is displayed in region 103 is calculated and acquired.

In Step S92, the determination section 57 determines whether or not the width (that is, width in the direction perpendicular to the scroll direction) of the target image acquired in the processing of Step S91 is equal to or more than a reduction threshold. The reduction threshold is set in advance in accordance with the size (width) of the region 103. The reduction threshold can be set to a value approximately equal to the width of the region 103, for example. In the case where the width of the target image is equal to or more than the reduction threshold, the scaling section 59 reduces the image in Step S93. That is, the width of the image 82 is adjusted such that it is not larger than the width of the region 103 (that is, adjusted such that it is smaller than the width of the region 103). In this case, at least only the scale of the lateral direction may be reduced, and the whole may be reduced as well.

Accordingly, the following case is prevented from occurring: a part in the lateral direction of the image 82 goes out of the region 103. As a result thereof, the user is able to observe the image 82 without any omission. Further, since it is not necessary for the user to manually perform the operation of scrolling the image 82 to the left and right or reducing the image 82, and thus, the operability is satisfactory.

On the contrary, in the case where it is determined in Step S92 that the width of the target image is not equal to or more than the reduction threshold, the determination section 57 determines in Step S94 whether or not the width (that is, width in the direction perpendicular to the scroll direction) of the target image is equal to or less than an enlargement threshold. The enlargement threshold is set in advance in accordance with the size (width) of the region 103. The enlargement threshold is set to a value smaller than the reduction threshold. In the case where the width of the target image is equal to or less than the enlargement threshold, the scaling section 59 enlarges the image in Step S95. That is, the width of the image 82 is adjusted to be within the range smaller than the width of the region 103, such that it is not too small in comparison to the width of the region 103. In this case, at least only the scale of the lateral direction may be enlarged, and the whole may be enlarged as well.

In this way, the user can confirm the image 82 in an appropriate size without performing manually the operation of enlarging the image 82, and thus, the operability is satisfactory.

In Step S94, in the case where it is determined that the width of the target image is larger than the enlargement threshold, since the image 82 is finally displayed with its width in an appropriate size within the region 103, the image 82 is displayed in the size as it is, without performing enlargement or reduction processing.

Figure 22:
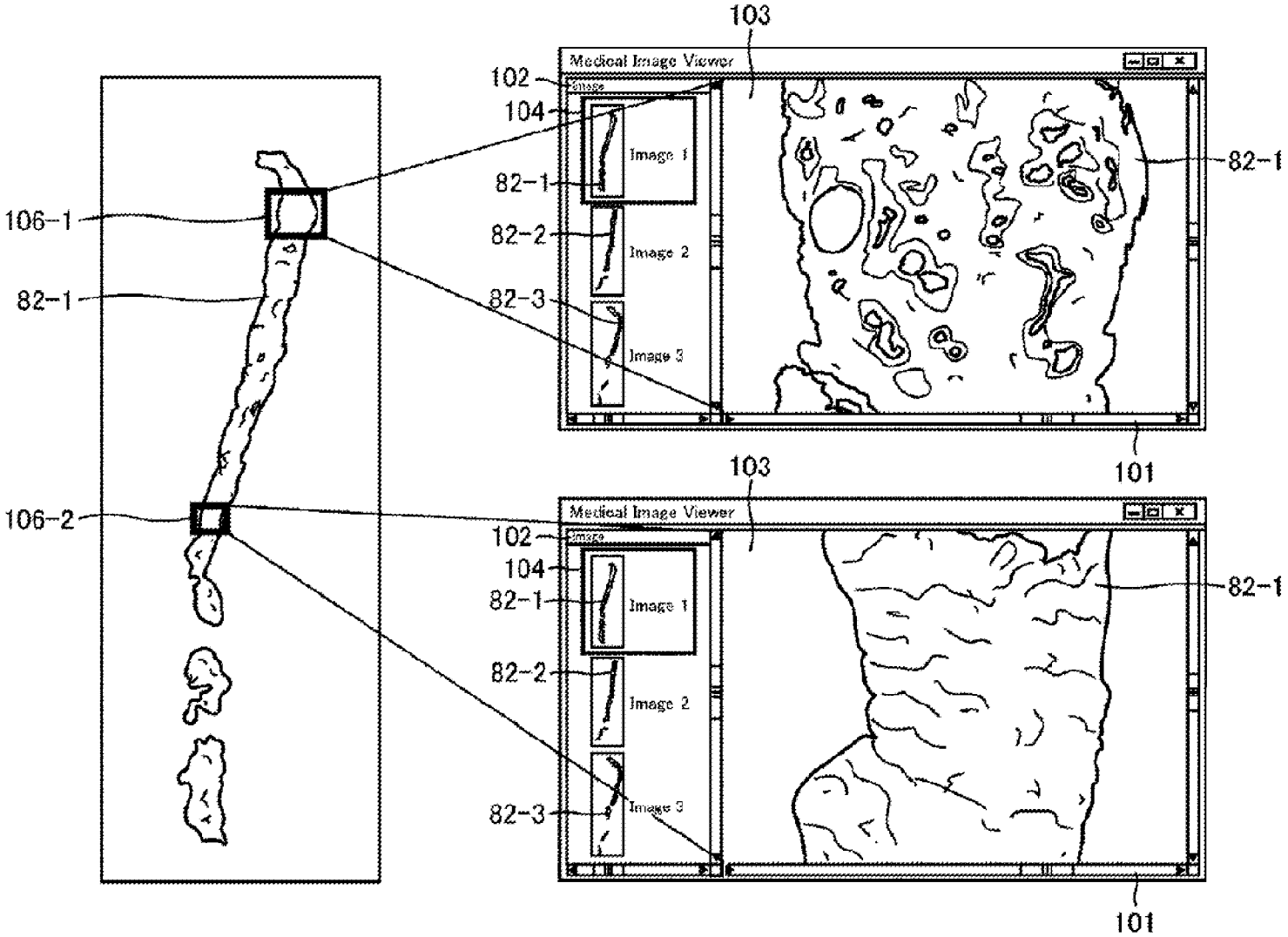
FIG. 22 is a diagram illustrating the width adjustment processing.

FIG. 22 is a diagram illustrating the width adjustment processing. As shown in FIG. 22, in the image 82-1, as for a part with a large width surrounded by a frame 106-1, the whole is reduced such that the image does not go out in the lateral direction of the region 103 of the screen 101 shown at the top-right, and is displayed as the image 82-1.

Further, in the image 82-1, as for a part with a small width surrounded by a frame 106-2, the whole is enlarged such that the width in the lateral direction is does not become extremely small, and is displayed as the image 82-1 having an appropriate width in the region 103 of the screen 101 shown at the bottom-right. In this way, since the part with a large width and the part with a small width are displayed in approximately the same width, the confirmation of the image becomes easy.

Back to FIG. 5, after the width adjustment processing is performed in Step S13, the movement section 58 scrolls the image upward or downward in Step S14. That is, in the case where the user operates the button 71U, the image 82 displayed in the region 103 is scrolled upward, and in the case of operating the button 71D, the image 82 is scrolled downward.

In this case, the display control section 56 performs control such that the center of the width in the lateral direction, which is the observation reference position of the image 82 that is an observation target image, passes through the center 122, which is the display reference position of the region 103. That is, the image 82 is scrolled such that the scroll line 95 passes through the center 122. In addition, in this case, it is also possible to perform control such that the scroll line 95 orients the vertical direction (y-axis direction of the region 103 of the screen 101) of the region 103 at all times. However, in that case, when the scrolling is performed, left and right points of interest of the scroll line 95 is also moved in the left and right directions according to the curve of the scroll line 95, and hence, it becomes difficult to perform observation on the contrary. Accordingly, in the present embodiment, it is controlled such that the y-axis direction (that is, the direction of the principal axis θ of inertia) of the region 84 is parallel to the y-axis direction of the region 103.

The scroll speed is a speed set in Step S82 or Step S83 of FIG. 19. That is, the scroll speed is basically a fixed standard speed, and is a fixed confirmation speed in the part having a tumor. Further, the image 82 is adjusted such that the width thereof fits into the range of the region 103 of the display section 101.

In Step S15, the determination section 57 determines whether it is an end part of the image in the scroll direction. In the case where it is still not the end part of the image, the processing proceeds to Step S16. In Step S16, the determination section 57 determines whether the instruction of the upward or downward scrolling is released. The user continuously operates the button 71U in the case of performing the upward scrolling, and discontinues the operation of the button 71U in the case of stopping the upward scrolling. Further, the user continuously operates the button 71D in the case of performing the downward scrolling, and stopping the operation of the button 71D in the case of discontinuing the downward scrolling.

In the case where the operation of the button 71U, 71D is discontinued, it is determined that the instruction of scrolling is released, and in the case where the operation is still continued, it is determined that the instruction of scrolling is not released yet. In the case where the instruction of scrolling is not released, the processing returns to Step S11, and the processing thereafter is repeated. That is, the scrolling is continued.

In the case where it is determined that the instruction of scrolling is released, the movement section 58 stops the upward or downward scrolling in Step S17. That is, when the user releases his/her hand from the button 71U, 71D, the scrolling is temporarily stopped. After that, the processing returns to Step S9.

In Step S9, it is determined again whether it is the automatic mode, and in the case where it is still the automatic mode, the processing from Step S10 onward is repeated. That is, in the case where the user operates the button 71U, 71D, the automatic scrolling is restarted.

While performing the automatic scrolling, when reaching an end part (lower or upper end part) in the scroll direction of the image 82, it is determined YES in Step S15, and the processing proceeds to Step S18. In Step S18, the movement section 58 terminates scrolling. In Step S19, the display control section 56 controls a display section to display scroll completion, as shown in FIG. 23, for example.

Figure 23:
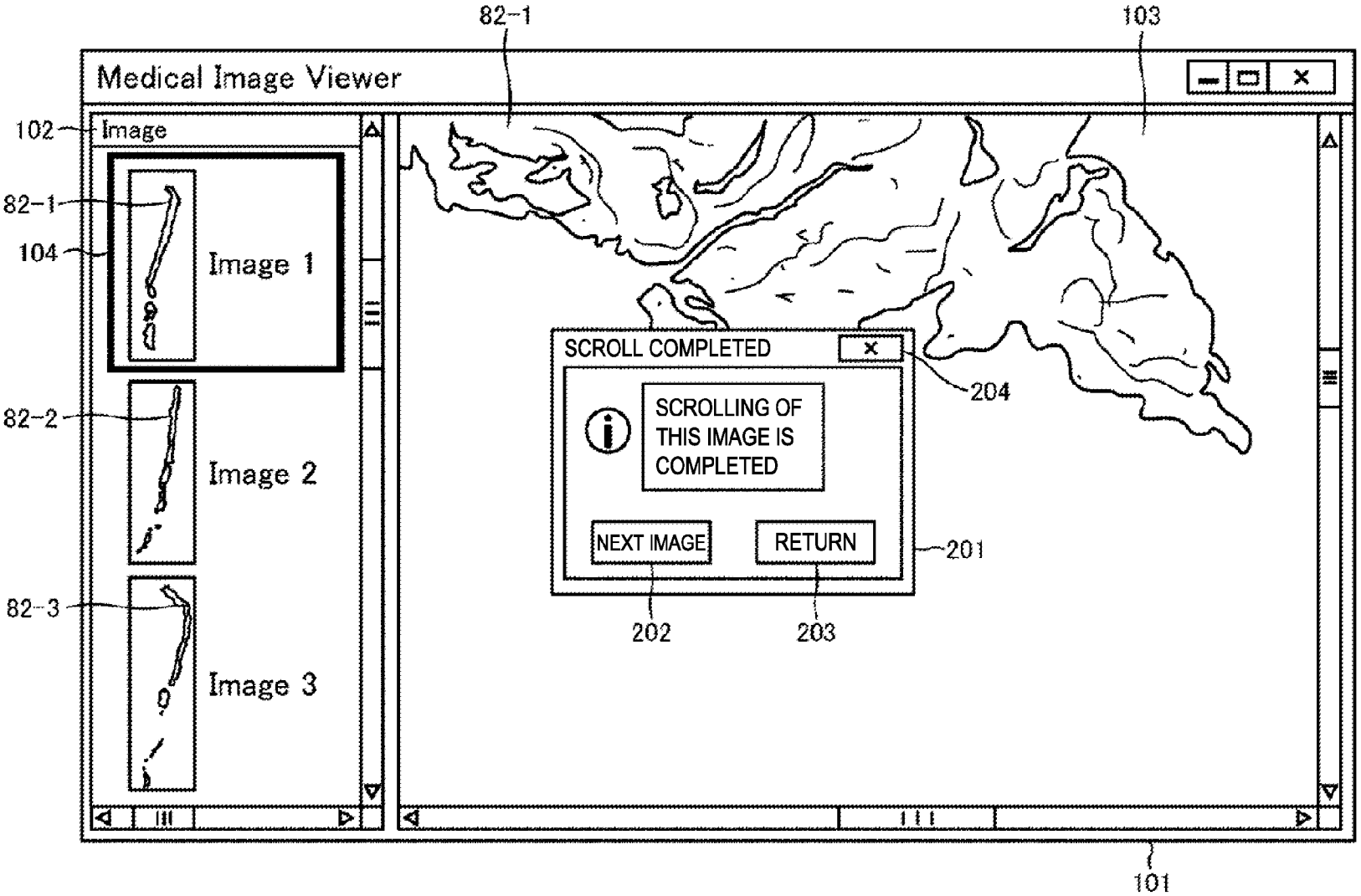
FIG. 23 is a diagram showing an example of a display of scroll completion.

FIG. 23 is a diagram showing an example of a display of scroll completion. In this example, a menu 201 is displayed. In the menu 201, the message of "SCROLLING OF THIS IMAGE IS COMPLETED". Further, there are displayed within the menu 201 a "NEXT IMAGE" button 202 and a "RETURN" button 203. In addition, at the top-right of the menu 201, a button 204 which is operated when closing the menu 201 is displayed. In this way, the following case is prevented from occurring: in the case where there is a break in the image 82, the user falsely recognizes that the user has confirmed the image 82 up to the end.

Figure 24:
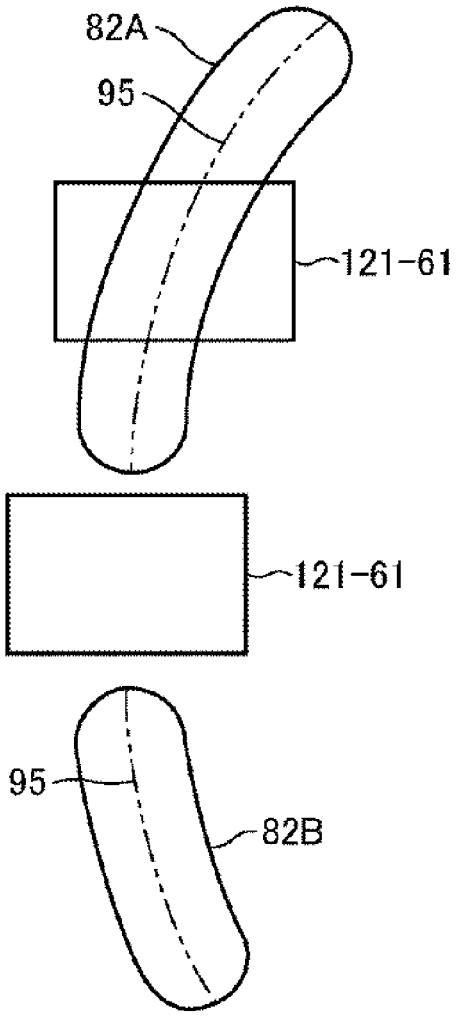
FIG. 24 is a diagram illustrating scrolling.

FIG. 24 is a diagram illustrating scrolling. In this example, the image 82 is separated into two parts of an upper part and a lower part, which are an image 82A and an image 82B. In such a case, while performing the automatic scrolling, when the image 82A is confirmed in a screen 121-61 and the observation position reaches the position where the image 82 is not present, which is in between the image 82A and the image 82B as shown in a screen 121-62, since the image 82 is not displayed, there is a risk that the user may misunderstand that the user has confirmed the whole image 82.

On the contrary, as shown in FIG. 23, when it is set such that the menu 201 is to be displayed at the scroll completion position, the user continues to perform scrolling until the menu 201 is displayed, and hence, the observation failure is prevented from occurring.

Figure 6:
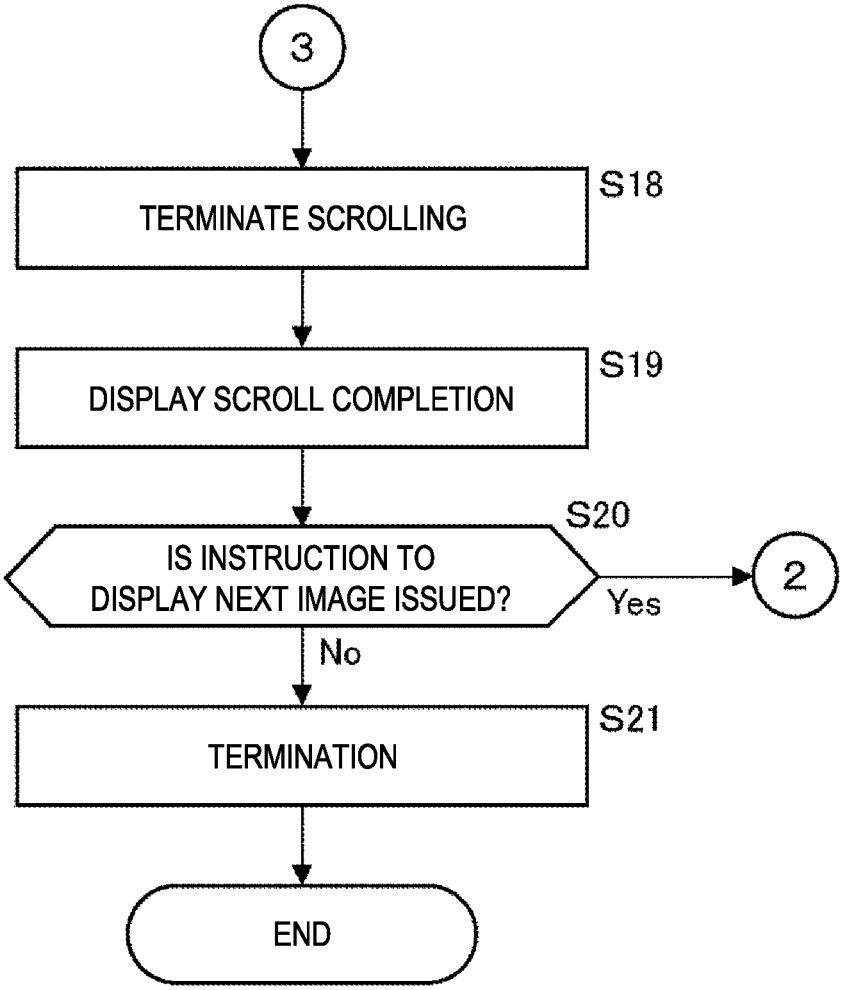
FIG. 6 is a flowchart illustrating the display processing.

After the scroll completion is displayed in Step S19 of FIG. 6, the determination section 57 determines whether an instruction to display the next image is issued in Step S20. In the case of observing the image 82-2 after observing the image 82-1, the user specifies the image 82-2 as the next image. In this case, the processing returns to Step S6 in FIG. 4, the specified image is newly acquired, and the same processing as the case described above is executed to the new image.

In the case where the instruction to display the next image is not issued, the display control section 56 controls a display section to terminate the display processing in Step S21.

In the case where, after temporarily stopping the automatic scrolling, the user wants to place and observe the left or right end part of the image 82 at the center of the screen, or to enlarge or reduce the image 82, the user operates the button 74. In this way, the automatic mode is released, and the manual mode is set instead. In this case, it is determined that the mode set in Step S9 of FIG. 5 is not the automatic mode, and the processing proceeds to Step S22.

In Step S22, whether an instruction of the upward or downward scrolling is issued is determined. In the case where the instruction of the upward or downward scrolling is not issued, the processing proceeds to Step S31, and the determination section 57 determines whether an instruction of the leftward or rightward scrolling is issued. In Step S31, in the case where the instruction of the leftward or rightward scrolling is not issued, the processing proceeds to Step S35. In Step S35, the determination section 57 determines whether an instruction of enlargement or reduction is issued. In the case where the instruction of enlargement or reduction is not issued, the processing returns to Step S9, and whether it is the automatic mode is determined again.

In the case where the manual scrolling mode is set, the user operates the button 71 or the button 72, thereby manually scrolling the image 82 upward, downward, leftward, and rightward, or manually scaling the image 82. Accordingly, as described above, in Steps S22, S31, and S35, whether the button 71 or the button 72 is operated is determined.

In Step S22, in the case where it is determined that the instruction of the upward or downward scrolling is issued, that is, in the case where the user operates the button 71U or 71D in the manual mode, the movement section 58 scrolls the image upward or downward in Step S23. That is, in the case where the user operates the button 71U, the image 82 displayed in the region 103 is scrolled upward, and in the case where the user operates the button 71D, the image 82 is scrolled downward.

In Step S24, the determination section 57 determines whether it is an end part of the image in the scroll direction. In the case where it is still not the end part of the image in the scroll direction, the processing proceeds to Step S29. In Step S29, the determination section determines whether the instruction of the upward or downward scrolling is released. The user continuously operates the button 71U in the case of performing the upward scrolling, and discontinues the operation of the button 71U in the case of stopping the upward scrolling. Further, the user continuously operates the button 71D in the case of performing the downward scrolling, and discontinues the operation of the button 71D in the case of stopping the downward scrolling.

In the case where the operation of the button 71U, 71D is discontinued, it is determined that the instruction of scrolling is released, and in the case where the operation is still continued, it is determined that the instruction of scrolling is not released yet. In the case where the instruction of scrolling is not released, the processing returns to Step S23, and the processing thereafter is repeated. That is, the scrolling is continued.

In the case where it is determined that the instruction of scrolling is released, the movement section 58 stops the upward or downward scrolling in Step S30. That is, when the user releases his/her hand from the button 71U, 71D, the scrolling is temporarily stopped. After that, the processing returns to Step S9.

While performing the manual scrolling, when reaching an end part (lower or upper end part) in the scroll direction of the image 82, it is determined YES in Step S24, and the processing proceeds to Step S25. In Step S25, the movement section 58 terminates scrolling. In Step S26, the display control section 56 controls a display section to display scroll completion, as shown in FIG. 23. Note that, the display of scroll completion may be omitted in the manual mode.

In Step S27, the determination section 57 determines whether an instruction to display the next image is issued. In the case of observing the image 82-2 after observing the image 82-1, the user specifies the image 82-2 as the next image. In this case, the processing returns to Step S6 in FIG. 4, the specified image is newly acquired, and the same processing as the case described above is executed to the new image.

In the case where the instruction to display the next image is not issued, the display control section 56 controls a display section to terminate the display processing in Step S28.

Figure 8:
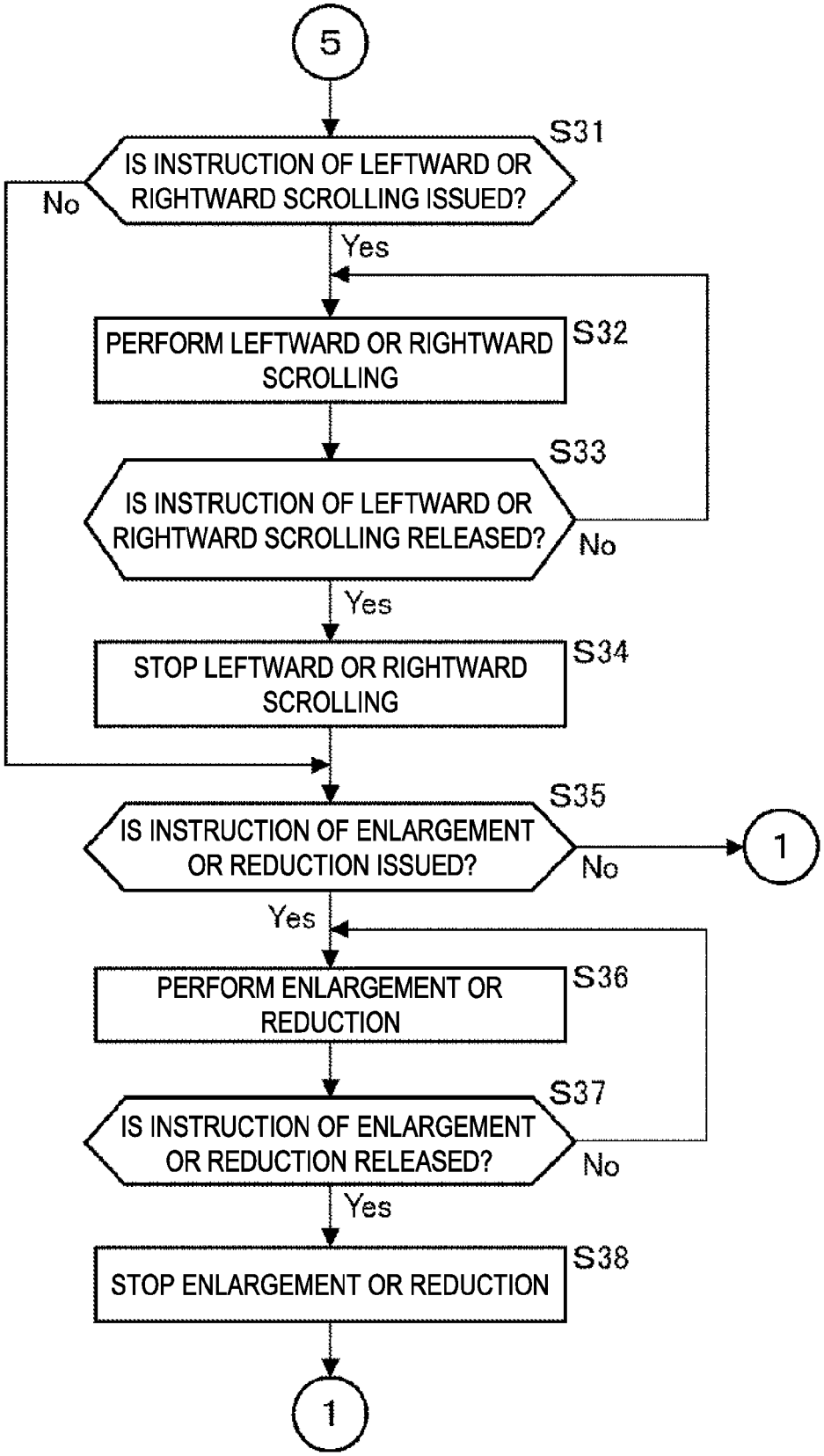
FIG. 8 is a flowchart illustrating the display processing.

On the other hand, in Step S31 of FIG. 8, in the case where the instruction of the leftward or rightward scrolling is issued, the movement section 58 scrolls the image leftward or rightward in Step S32. In the case of performing the leftward scrolling, the user operates the button 71L, and in the case of performing the rightward scrolling, the user operates the button 71R.

In Step S33, the determination section 57 determines whether the instruction of the leftward or rightward scrolling is released. The user continuously operates the button 71L, 71R in the case of continuing scrolling, and discontinues the operation of the button 71L, 71R in the case of discontinuing scrolling. In the case where the operation of the button 71L, 71R is being continued, the processing returns to Step S32, and the leftward or rightward scrolling is continued.

In the case where it is determined that the instruction of the leftward or rightward scrolling is released, the movement section 58 stops the leftward or rightward scrolling in Step S34. After that, the processing proceeds to Step S35.

In Step S35, the determination section 57 determines whether the instruction of enlargement or reduction is issued. In the case where the instruction of enlargement or reduction is issued, the scaling section 59 enlarges or reduces the image 82 in Step S36. When enlarging the image, the user operates the button 72 upward, and when reducing the image, the user operates the button 72 downward. When the operation of the button 72 is discontinued, it is determined that the instruction of enlargement or reduction is released.

In Step S37, the determination section 57 determines whether the instruction of enlargement or reduction is released. In the case where it is still not released, the processing returns to Step S36, and the processing of Steps S36 and S37 is repeated until the instruction is released.

In the case where the instruction of enlargement or reduction is released in Step S37, the scaling section 59 stops the enlargement or reduction in Step S38. Also in the case where the enlargement or reduction is performed up to a limit, the enlargement or reduction is stopped.

Figure 25:
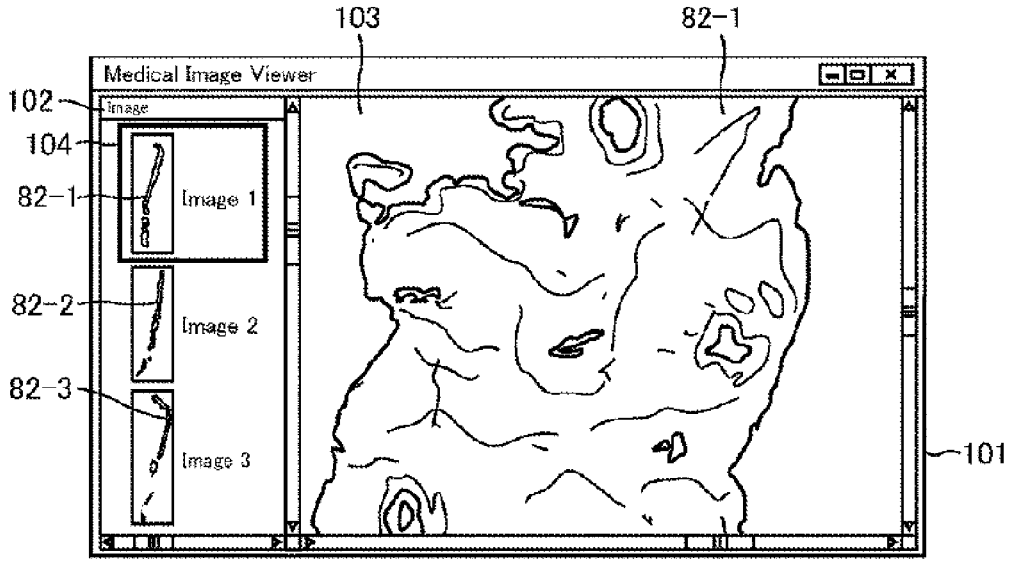
FIG. 25A and FIG. 25B are each a diagram illustrating scaling processing.
Figure 25:
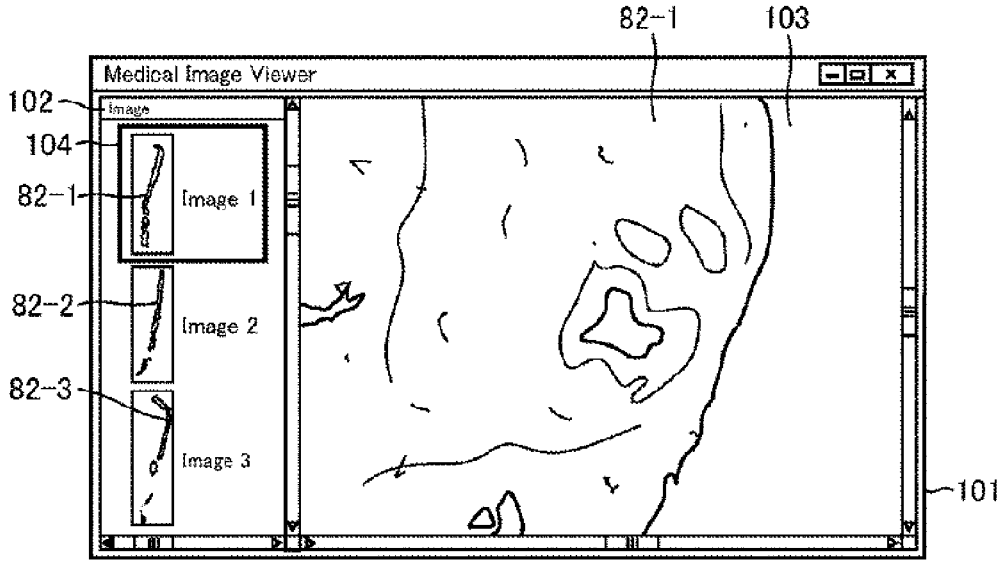

FIG. 25A and FIG. 25B are each a diagram illustrating scaling processing. FIG. 25A represents a display state before enlarging the image 82-1, and FIG. 25B represents a display state after enlarging the image 82-1. In the case where the button 72 is operated downward in the state shown in FIG. 25B, the image 82-1 is reduced and displayed as shown in FIG. 25A.

As described above, according to the embodiment, in the case where the automatic mode is set, the image is scrolled at a fixed speed while the button 71U, 71D is being operated. It is also possible to cause the scrolling to be continued once the button 71U, 71D is operated, even when the operation is released. However, in this way, the concentration at the time of observation is diminished, and therefore, it is preferred that the scrolling be executed only while the button 71U, 71D is continuously operated.

Note that, in the above, in scrolling the image 82 in the longitudinal direction, the vertical direction of the display section 101 is used as the scroll direction, the longitudinal direction can be also scrolled in the lateral direction. In this case, the reduction threshold and the enlargement threshold are determined in accordance with the length of the vertical direction of the region 103.

[Lesion Progression Label]

In Step S84 of FIG. 19, a tumor is surrounded by the line 151 and highlighted, and a lesion progression label can also be displayed.

Figure 26:
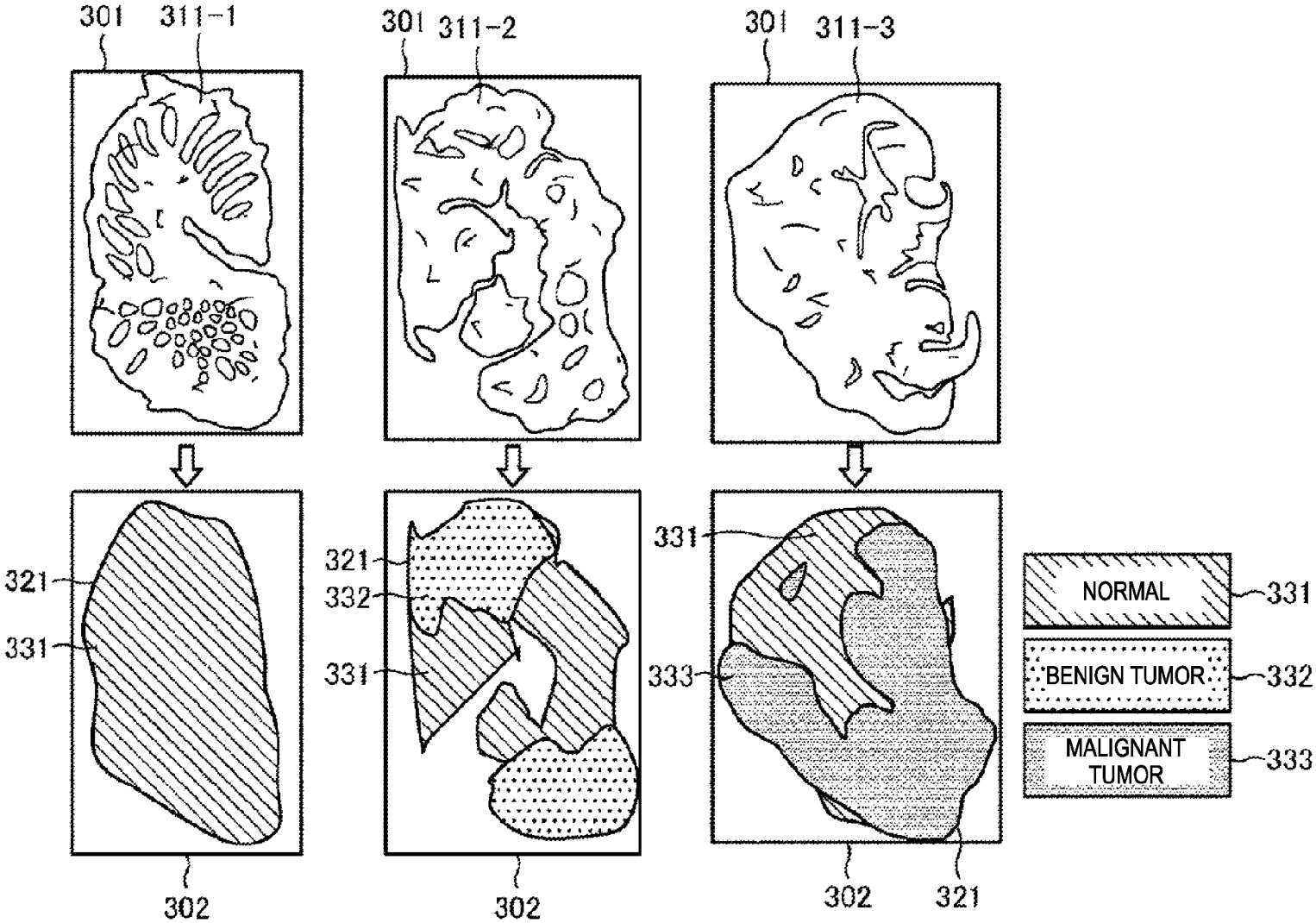
FIG. 26 is a diagram illustrating lesion progression labels.

FIG. 26 is a diagram illustrating lesion progression labels. In FIG. 26, three pathology images 301 are displayed on the top, and underneath the pathology images 301, there are displayed label images 302 shown with the corresponding lesion progression labels. In the pathology image 301 at the left hand side, a tissue image 311-1 is shown, in the pathology image 301 at the center, a tissue image 311-2 is shown, and in the pathology image 301 at the right hand side, a tissue image 311-3 is shown.

As for the tissue image 311-1, since the whole thereof is normal, in the label image 302, the whole of a region 331 among a region 321 corresponding to the tissue image 311-1 is displayed in a first label color (for example, green). As for the tissue image 311-2, a part thereof is a benign tumor and the other part is normal. Accordingly, in that label image 302, a region 332 which is the benign tumor part among the region 321 corresponding to the tissue image 311-2 is displayed in a second label color (for example, yellow) that is different from the normal part, and the region 331 that is the remaining normal part is displayed in the first label color.

As for the tissue image 311-3, a part thereof is a malignant tumor, and the other part is normal. Accordingly, in that label image 302, a region 333 which is the malignant tumor among the region 321 corresponding to the tissue image 311-3 is displayed in a third label color (for example, red) that is different from the normal part and the benign tumor, and the region 331 that is the remaining normal part is displayed in the first label color.

In this way, the label image labelled with different colors is displayed according to the degree of lesion progression, and thus, a tumor can be easily found.

Figure 27:
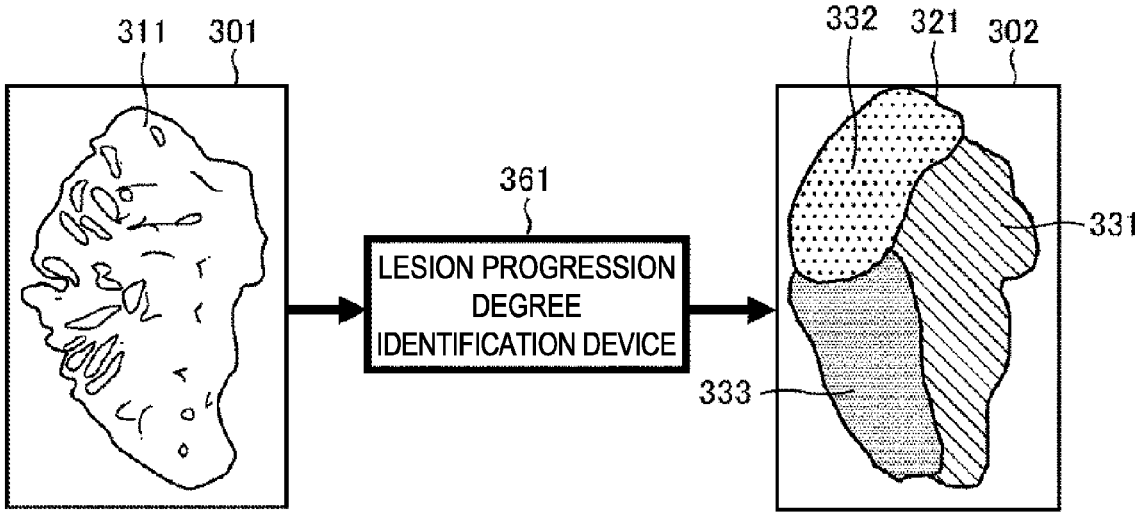
FIG. 27 is a diagram illustrating identification of a degree of lesion progression.

FIG. 27 is a diagram illustrating identification of a degree of lesion progression. In order to obtain the label image 302 from the pathology image 301, as shown in FIG. 27, it is necessary to use a lesion progression degree identification device 361 which detects a tumor from the pathology image 301 and labels the detection result. In the present embodiment, the detection section 52 shown in FIG. 2 functions as the lesion progression degree identification device 361.

[Creation of Dictionary]

Figure 4:
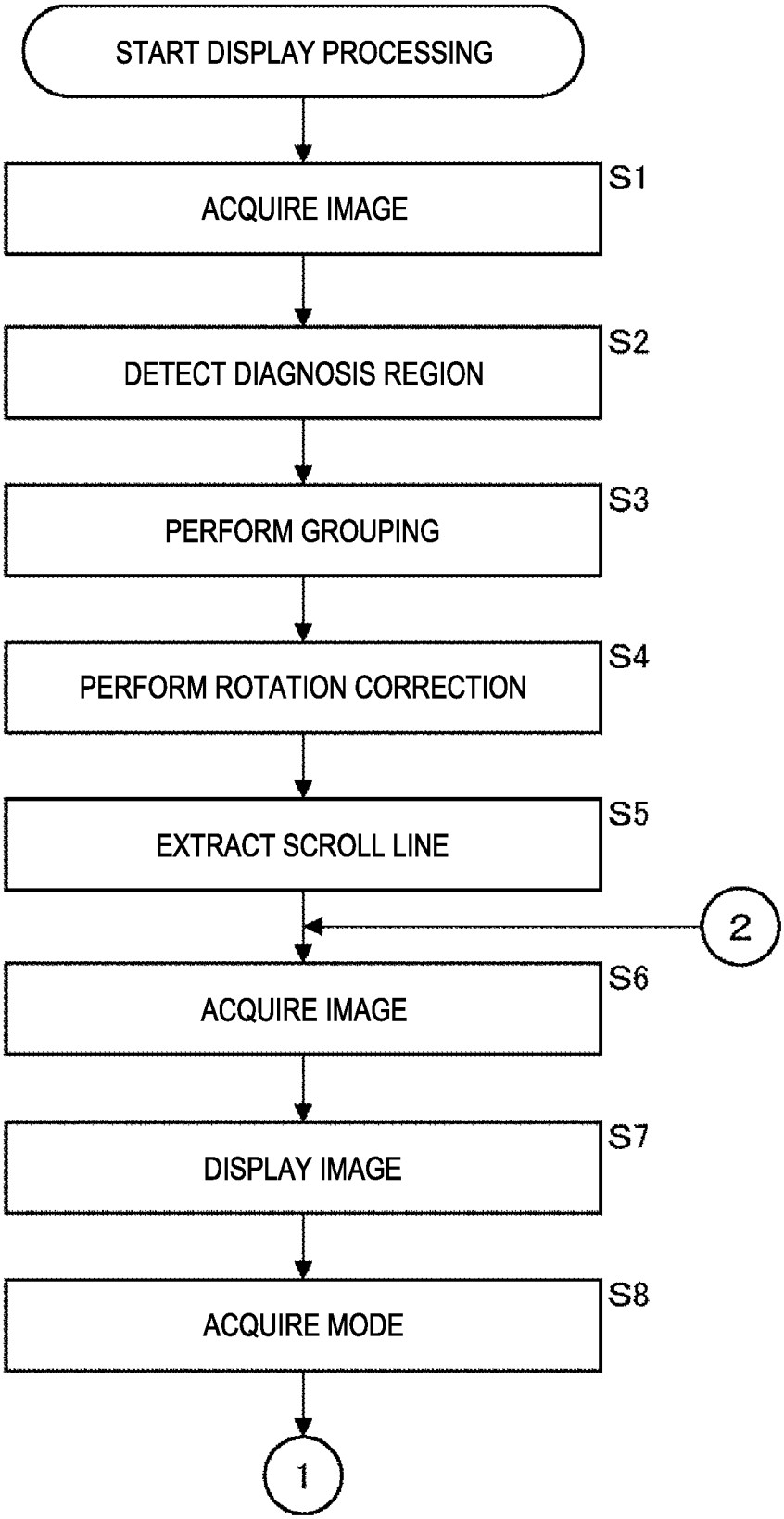
FIG. 4 is a flowchart illustrating display processing.

For performing the processing of detecting a diagnosis region in Step S2 of FIG. 4, a dictionary is necessary for identifying the region of cellular tissue from the background.

Figure 28:
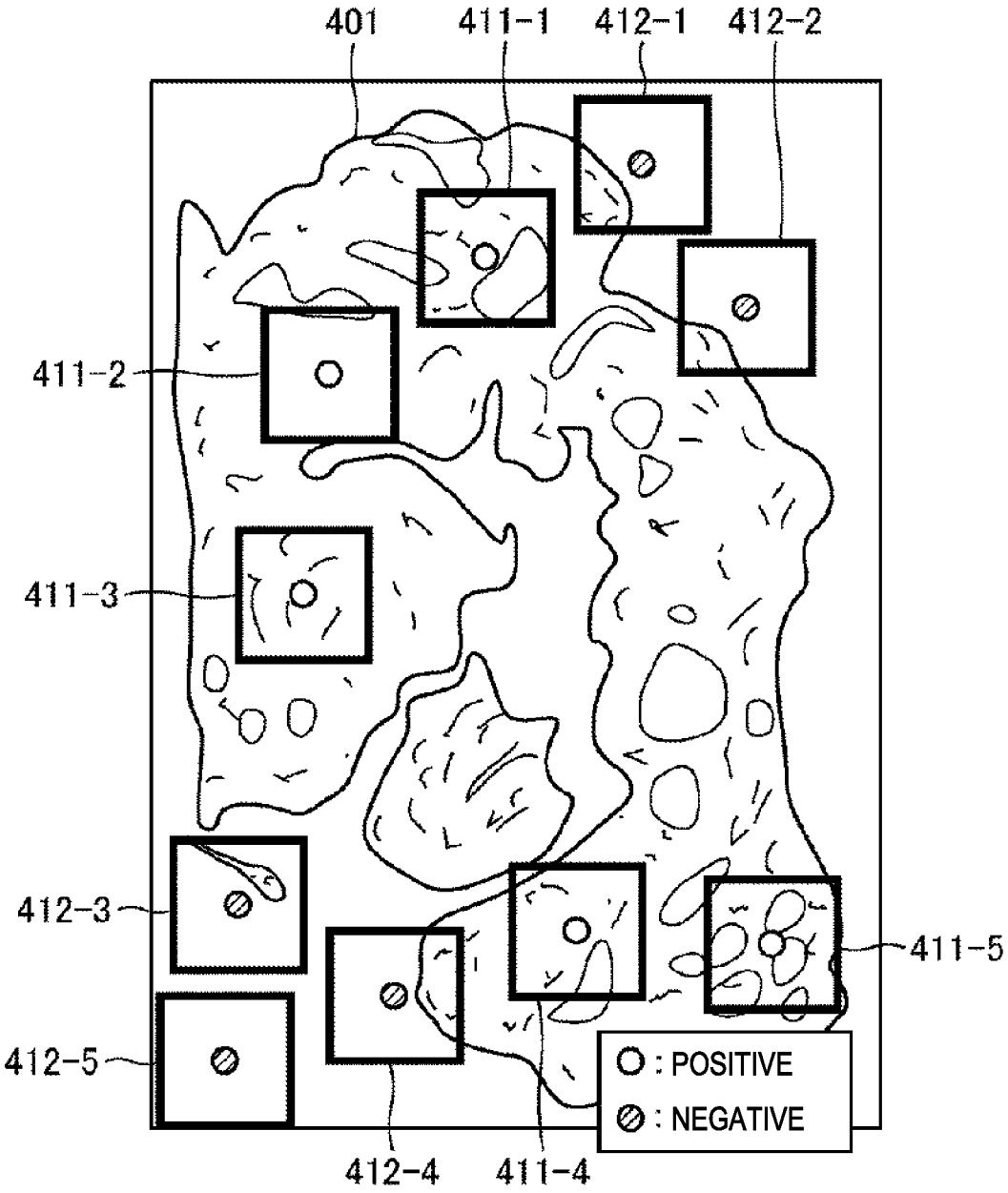
FIG. 28 is a diagram illustrating a learning sample.
Figure 29:
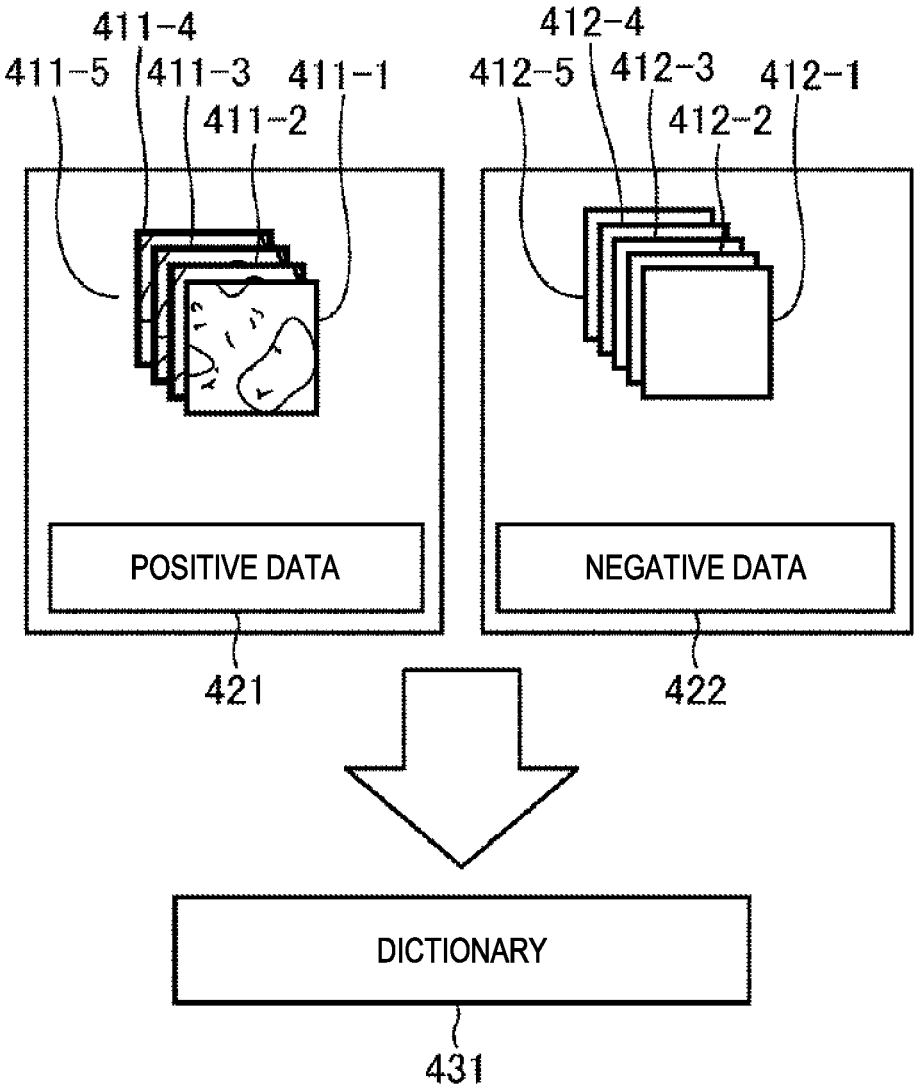
FIG. 29 is a diagram illustrating creation of a dictionary.

FIG. 28 is a diagram illustrating a learning sample, and FIG. 29 is a diagram illustrating creation of a dictionary. For detecting the diagnosis region, it is necessary to perform learning such that the cellular tissue region can be distinguished from the background, and to create a dictionary.

Accordingly, as shown in FIG. 28, first, cellular tissue region images 411-1 to 411-5 and background images 412-1 to 412-5 are acquired from a sample image 401. In this example, although the number of the cellular tissue region images is five and the number of background images is five, in practice, the number of the images is larger than those.

The learning is performed such that positive data 421 formed of the thus acquired cellular tissue region images 411-1 to 411-5 can be distinguished from negative data 422 formed of the background images 412-1 to 412-5, and in this way, a dictionary 431 can be generated.

Further, in the case of performing highlight display in Step S84 of FIG. 19, in order to further detect a tumor from the detected cellular tissue, the learning is performed using the data of tumor as the positive data. Further, as shown in FIG. 27, in the case of detecting the degree of lesion progression using the lesion progression degree identification device 361, the learning is performed using the data of the benign tumor and the malignant tumor as the positive data.

In order to display the diagnosis region, to perform display of surrounding a tumor with a line, and to display a label image showing a degree of lesion progression, the thus generated dictionary 431 is used.

[Learning Method]

Next, there will be described a learning method performed by a learning machine 500 which generates the dictionary 431. Hereinafter, for simplicity of the description, a dictionary for identifying a cellular tissue from the background is to be created. Note that the learning machine 500 is realized by using a program executed by the CPU 21.

There is prepared an image (training data) which is to be a learning sample that is labelled (attached with a correct answer) in advance by work of a person, as the premise of a pattern identification problem of a general two-class classification, such as a problem of determining whether or not given data is a cellular tissue. The learning sample is formed of an image group (positive sample) which is obtained by clipping a region of a target object to be detected and a random image group (negative sample) which is obtained by clipping an entirely unrelated part such as a background image.

A learning algorithm is applied based on those learning samples, and learning data used at the time of the classification is generated. The learning data used at the time of the classification includes, in the present embodiment, the following four pieces of learning data including the learning data described above.

(A) Group of two pixel positions (number: K)

(B) Threshold of weak classifier (number: K)

(C) Weight of weighted majority vote (reliability of weak classifier) (number: K)

(D) Closing threshold (number: K)

(1) Generation of Classifier

Hereinafter, there will be described an algorithm for learning the four types of learning data shown in the above items (A) to (D) based on a large number of learning samples as described above.

Figure 30:
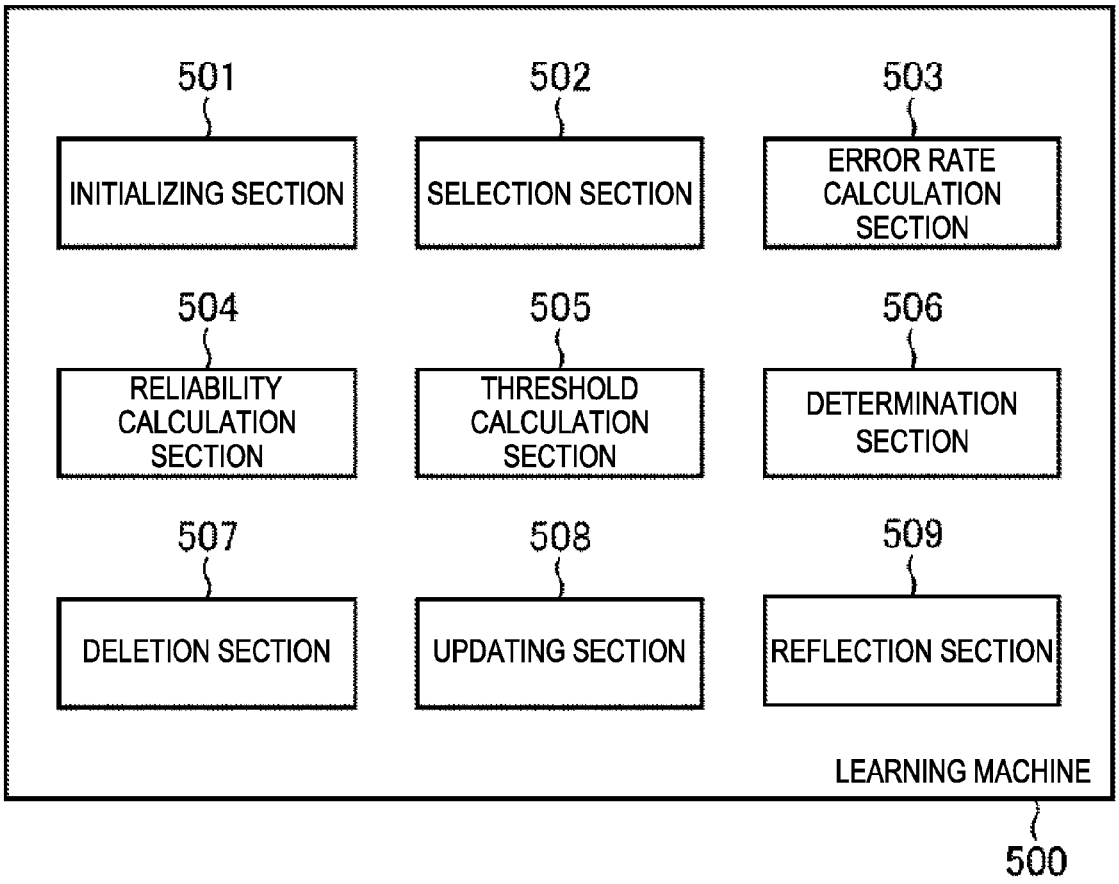
FIG. 30 is a block diagram showing a functional configuration of a learning machine.

For executing the learning processing, the learning machine 500 has a functional configuration as shown in FIG. 30. The learning machine 500 can be configured from the CPU 21. According to the present embodiment, the learning machine 500 includes an initializing section 501, a selection section 502, an error rate calculation section 503, a reliability calculation section 504, a threshold calculation section 505, a determination section 506, a deletion section 507, an updating section 508, and a reflection section 509. The respective sections are, although not shown, capable of appropriately transmitting/receiving data therebetween.

The initializing section 501 executes processing of initializing a data weight of a learning sample. The selection section 502 performs selection processing of a weak classifier. The error rate calculation section 503 calculates a weighted error rate $e_t$. The reliability calculation section 504 calculates reliability $\alpha_t$. The threshold calculation section 505 calculates an identification threshold $R_M$ and a learning threshold $R_L$. The determination section 506 determines whether or not the number of samples is sufficient. The deletion section 507 deletes, in the case where the number of samples is sufficient, the learning sample labelled as a negative sample, that is, a non-target object. The updating section 508 updates a data weight $D_t$ of a learning sample. The reflection section 509 manages the number of times the learning processing is performed.

Figure 31:
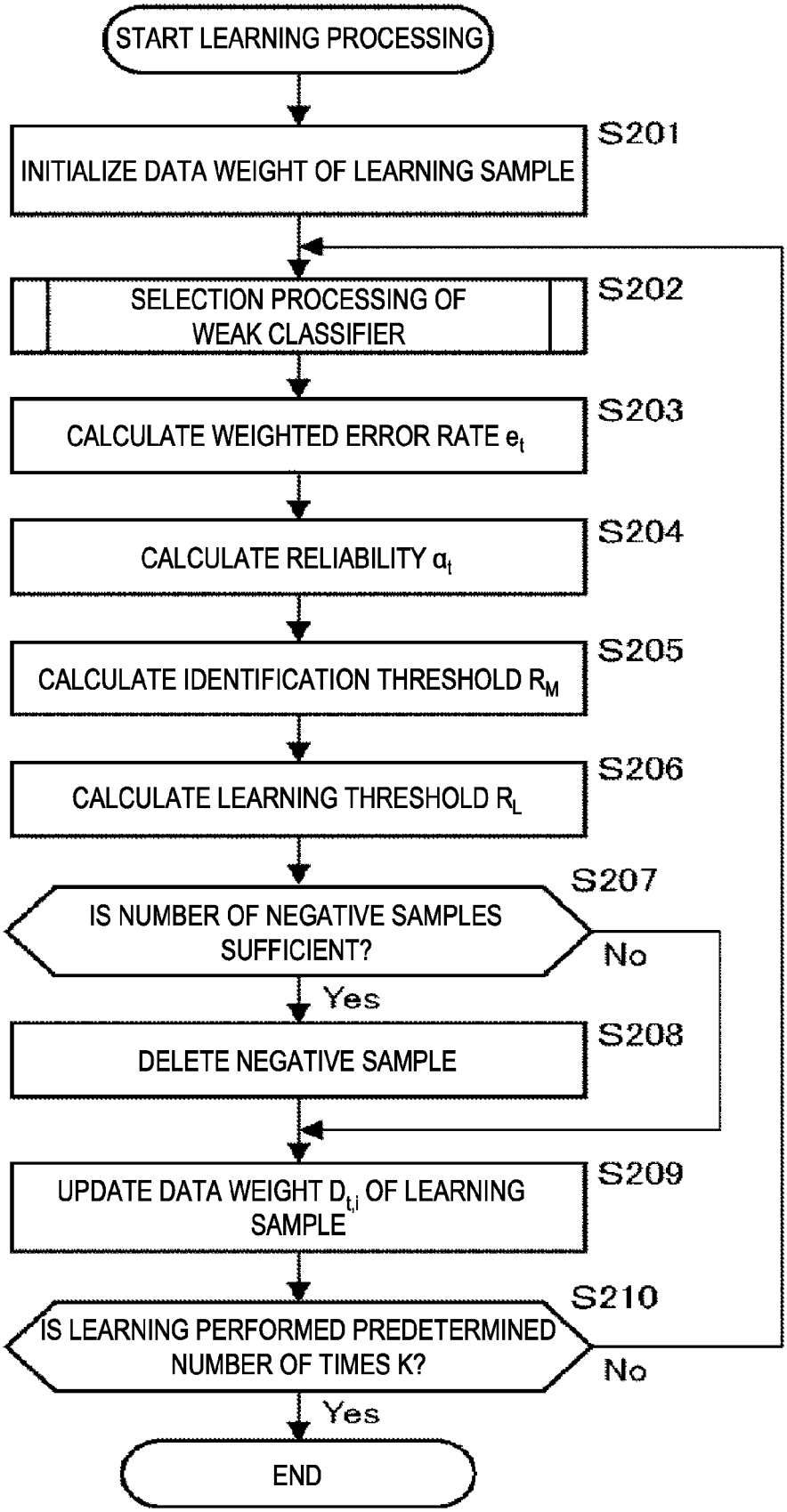
FIG. 31 is a flowchart illustrating learning processing.

FIG. 31 is a flowchart showing a learning method of the learning machine 500. Note that, here, the description will be made on the learning based on an algorithm (AdaBoost) used as a learning algorithm, which uses a fixed value for a threshold at the time of performing weak classification, but the learning algorithm is not limited to AdaBoost as long as it is an algorithm in which group learning is performed for combining multiple weak classifiers, such as Real-AdaBoost that uses a continuous value indicating certainty (probability) of being a correct answer as the threshold.

As described above, first, there are prepared learning samples $(x_i,y_i)$ each labelled in advance with a label indicating that it is the target object or that it is the non-target object, the number of the learning samples $(x_i,y_i)$ being N.

The learning samples represent N images, and for example, one image is formed of 24×24 pixels. Each learning sample represents an image of cellular tissue.

Note that $x_i$, $y_i$, X, Y, and N each represent the following.

Learning sample $(x_i,y_i)$: $(x_1,y_1), \ldots, (x_N,y_N)$ $x_i \in X$, $y_i \in \{-1,1\}$ X: Data of learning sample Y: Label of learning sample (correct answer)

N: Number of learning samples

That is, $x_i$ represents a feature vector formed of all luminance values of learning sample images. Further, $y_i=-1$ means that the learning sample is labelled as the non-target object, and $y_i=1$ means that the learning sample is labelled as the target object.

In Step S201, the initializing section 501 initializes the data weight of the learning sample. In the boosting, the weight (data weight) of each learning sample is made different, and the data weight on the learning sample in which it is difficult to perform the classification is made relatively large. The classification result is used to calculate an error rate (error) for evaluating the weak classifier, and the classification result is multiplied by the data weight, and thus, the evaluation of the weak classifier which makes an error in the classification of the learning sample in which it is more difficult to perform the classification falls below an actual classification rate. In Step S209 to be described later, although the data weight is updated one by one, the initialization of the data weight of this learning sample is performed first. The initialization of the data weight of the learning sample is performed by making the weights of all learning samples constant, and is defined as Equation (7) shown below.

$$D_{1,i} = \frac{1}{N} \tag{7}$$

Data weight $D_{1,i}$ of the learning sample represents the data weight of learning sample $x_i$ ($=x_1$ to $x_N$) of repetition number t=1. N represents the number of learning samples.

The selection section 502 performs selection processing (generation) of the weak classifier in Step S202. The detail of the selection processing will be described later with reference to FIG. 34, and by performing this processing, one weak classifier is generated for each repeating processing from Steps S202 to S209.

In Step S203, the error rate calculation section 503 calculates the weighted error rate $e_t$. Specifically, the weighted error rate $e_t$ of the weak classifier generated in Step S202 is calculated using the following Equation (8).

$$e_t = \sum_{i:f_t(x_i)\neq y_i} D_{t,i} \tag{8}$$

As shown in Equation (8) above, the weighted error rate $e_t$ is determined by performing addition of only data weights of learning samples (learning sample labelled $y_i=1$ which is determined as $f_t(x_i)=-1$, and learning sample labelled $y_i=-1$ which is determined as $f_t(x_i)=1$) in which the classification result of the weak classifier is incorrect ($f_t(x_i)\neq y_i$) among the learning samples. As described above, when making an error in the classification of the learning sample having a large data weight $D_{t,i}$ (in which the classification thereof is difficult), the weighted error rate $e_t$ increases. Note that the weighted error rate $e_t$ is less than 0.5, and the reason therefor will be described later.

In Step S204, the reliability calculation section 504 calculates the reliability $\alpha_t$ of the weak classifier. Specifically, the reliability $\alpha_t$ that is a weight of a weighted majority vote is calculated using the following Equation (9) based on the weighted error rate $e_t$ shown in the above Equation (8). The reliability $\alpha_t$ represents the reliability of the weak classifier generated in the repetition number t.

$$\alpha_t = \frac{1}{2}\ln\left(\frac{1-e_t}{e_t}\right) \tag{9}$$

As is clear from the above Equation (9), the smaller the weighted error rate $e_t$, the larger the reliability $\alpha_t$ of the weak classifier.

In Step S205, the threshold calculation section 505 calculates the identification threshold $R_M$. The identification threshold $R_M$ is, as described above, a closing threshold (reference value) for closing the classification in the classification process. As for the identification threshold $R_M$, the smallest value is selected among the values of weighted majority votes of learning samples (positive samples) $x_1$ to $x_j$ that are target objects, or 0, in accordance with the above Equation (8). Note that, as described above, it is the case of using AdaBoost which performs the classification by setting the threshold to 0 that the smallest value or 0 is set as the closing threshold. In any case, the closing threshold $R_M$ is set to the largest value that makes it possible for at least all positive samples can pass through.

Next, in Step S206, the threshold calculation section 505 calculates the learning threshold $R_L$. The learning threshold $R_L$ is calculated based on the following Equation (10).

$$R_L = R_m - m \tag{10}$$

Note that, in the above equation, m represents a positive value, and represents a margin. That is, the learning threshold $R_L$ is set to a value that is smaller than the identification threshold $R_M$ by the margin m.

Next, in Step S207, the determination section 506 determines whether the number of the learning samples is sufficient. Specifically, in the case where the number of the negative samples is equal to or more than ½ of the number of the positive samples, it is determined that the number of the negative samples is sufficient. In the case where the number of the negative samples is equal to or more than ½ of the number of the positive samples, the deletion section 507 deletes the negative sample in Step S208. Specifically, the negative sample is deleted, in which the value F(x) of the weighted majority vote represented by Equation (11) is smaller than the learning threshold $R_L$ calculated in Step S206.

$$F(x) = \sum_t \alpha_t f_t(x) \tag{11}$$

In Equation (11), t (=1, . . . , K) represents the number of weak classifiers, $\alpha_t$ represents a weight (reliability) of a majority vote corresponding to each weak classifier, and $f_t(x)$ represents an output of each weak classifier.

In Step S207, in the case where the number of the negative samples is less than ½ of the number of the positive samples, the processing of deleting the negative sample performed in Step S208 is skipped.

Figure 32:
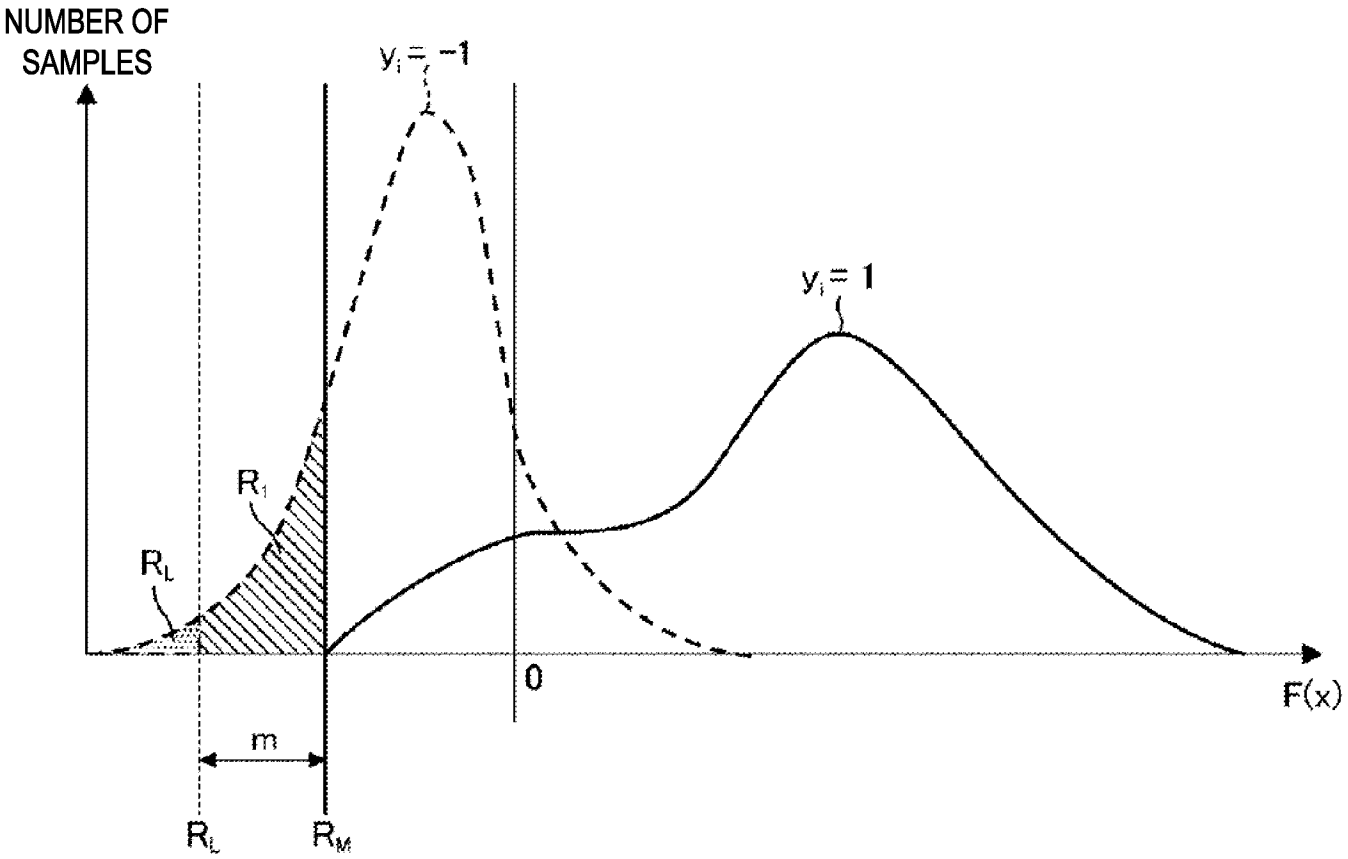
FIG. 32 is a diagram illustrating an identification threshold and a learning threshold.

When this is described with reference to FIG. 32, it is as follows. That is, FIG. 32 is a diagram illustrating an identification threshold and a learning threshold. That is, FIG. 32 shows a distribution of the value F(x) of the weighted majority vote with respect to the number of learning samples (vertical axis) in the case where the learning progresses to some extent (in the case where the t-th learning is performed). The solid line represents the distribution of the positive sample (learning sample labelled $y_i=1$), and the dashed line represents the distribution of the negative sample (learning sample labelled $y_i=-1$).

While learning, using the identification threshold $R_M$ as the reference, in the case where the value of the weighted majority vote F(x) becomes smaller than the identification threshold $R_M$, a part of the negative sample can be deleted.

That is, during the classification process, as shown in FIG. 32, a sample in a region $R_1$ whose value F(x) of the weighted majority vote is smaller than the identification threshold $R_M$ among the negative samples is substantially deleted (rejected) from the determination target.

In this way, the sample deleted (rejected) from the determination target during the classification process is also deleted (rejected) during the learning process, and hence, it becomes possible to perform learning such that the weighted error rate $e_t$ to become zero. However, it is known that, from the viewpoint of the properties of the statistical learning, the generalization ability (identification ability with respect to one piece of data) of the weak classifier is lowered when the number of samples is decreased. Further, it is known that, in the boosting learning, it can be expected that the generalization capability is further enhanced by continuing the learning even when the weighted error rate $e_t$ of the learning sample becomes zero. In this case, since all negative samples are smaller than the identification threshold $R_M$, the negative sample becomes zero, or even if the negative sample does not become zero, it is likely that the outputs of weak classifiers are distant from each other when there is a large difference between the number of positive samples and the number of negative samples.

Accordingly, in the present embodiment, by setting the learning threshold $R_L$ obtained by subtracting a fixed margin m from the identification threshold $R_M$ in the classification process, it becomes possible to gradually decrease some of the learning samples that show extreme outputs, and to quickly converge the learning while retaining the generalization capability.

Accordingly, in the processing of Step S208, the weighted majority vote F(x) is calculated, and among the negative samples, the negative sample in a region $R_2$ whose value of the weighted majority vote F(x) is smaller than the learning threshold $R_L$ of FIG. 32 is deleted.

In Step S209, the updating section 508 updates the data weight $D_{t,i}$ of the learning sample. That is, the data weight $D_{t,i}$ of the learning sample is updated using the following Equation (12), by using the reliability $\alpha_t$ obtained in the above Equation (9). It is necessary the data weight $D_{t,i}$ be normalized such that the total of all pieces of data weight $D_{t,i}$ is generally 1. Here, the data weight $D_{t,i}$ is normalized as shown in Equation (13).

$$D_{t+1,i} = D_{t,i}\exp(-\alpha_i y_i f_i(x_i)) \tag{12}$$

$$D_{t+1,i} = \frac{D_{t+1,i}}{\sum_i D_{t+1}} \tag{13}$$

Then, in Step S210, the reflection section 509 determines whether the learning is performed a predetermined number of times K (the number of times of boosting being K), and in the case where the number of times the learning is performed is still not K, the processing returns to Step S202, and the processing thereafter is repeated.

K represents the number of combinations capable of extracting two pieces of pixel data from pixel data of one learning sample. For example, in the case where one learning sample is formed of 24×24 pixels, K is $24^2\times(24^2-1)=576\times575=331200$.

Since one weak classifier is formed with respect to a combination of a group of pixels, one weak classifier is generated by performing the processing from Steps S202 to Step S209 once. Therefore, when the processing from Steps S202 to Step S209 is repeated K times, the weak classifiers, the number of which being K, are generated (learned).

In the case where the learning is performed K times, the learning processing is completed.

(2) Generation of Weak Classifier

Next, there will be described the selection processing (generation method) performed by the weak classifier in Step S202 described above. The generation of the weak classifier in the case where the weak classifier is a two-value output is different from the generation of the weak classifier in the case where the weak classifier outputs a continuous value as the function f(x) shown in the following Equation (14).

$$f(x)=P_p(x)-P_n(x) \tag{14}$$

That is, the weak classifier for performing a stochastic output solves a classification problem using a certain fixed value (threshold), and outputs a degree of the input image being the target object as a probability density function, which is different from the case of performing two-value output (f(x)=1 or −1).

The stochastic output indicating the degree (probability) of being the target object can be represented by the function f(x) shown in Equation (14), where, when a pixel difference feature d ($=I_1-I_2$) that is the difference between luminance values $I_1$ and $I_2$ of two pixels, $P_p(x)$ represents a probability density function of a target object of the learning sample and $P_n(x)$ represents a probability density function of a non-target object of the learning sample.

Further, also in the case of performing the two-value output, the processing in the case where the classification is performed using one threshold $Th_1$ as shown in Equation (15) slightly differs from the case where the classification is performed using two thresholds $Th_{11}$, $Th_{12}$. $Th_{21}$, $Th_{22}$, as shown in Equation (16) or Equation (17). Here, there will be described the learning method (generation method) performed by the weak classifier which performs the two-value output using one threshold $Th_1$.

$$I_1-I_2>Th_1 \tag{15}$$

$$Th_{11}>I_1-I_2>Th_{12} \tag{16}$$

$$I_1-I_2<Th_{21} \text{ or } Th_{22}>I_1-I_2 \tag{17}$$

Figure 33:
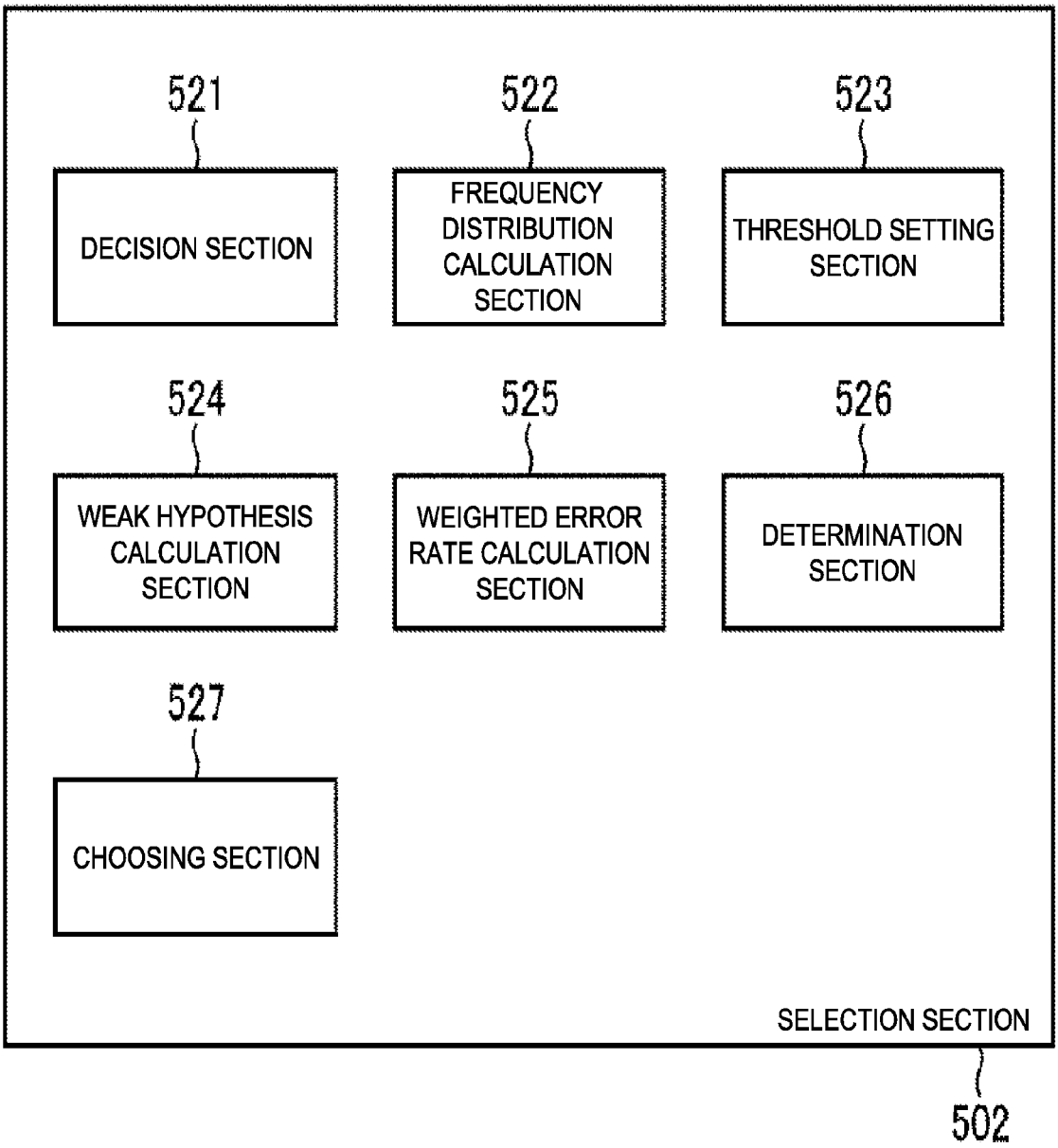
FIG. 33 is a block diagram showing a functional configuration of a selection section.

Accordingly, as shown in FIG. 33, the selection section 502 includes a decision section 521, a frequency distribution calculation section 522, a threshold setting section 523, a weak hypothesis calculation section 524, a weighted error rate calculation section 525, a determination section 526, and a choosing section 527.

The decision section 521 determines randomly two pixels from the input learning sample. The frequency distribution calculation section 522 collects pixel difference feature d of the pixels determined by the decision section 521, and calculates the frequency distribution thereof. The threshold setting section 523 sets a threshold of a weak classifier. The weak hypothesis calculation section 524 performs the calculation of a weak hypothesis using the weak classifier, and outputs the classification result f(x).

The weighted error rate calculation section 525 calculates the weighted error rate $e_t$ shown in Equation (8). The determination section 526 determines a magnitude relation between the threshold Th of the weak classifier and the maximum pixel difference feature d. The choosing section 527 chooses the weak classifier corresponding to the threshold Th corresponding to the minimum weighted error rate $e_t$.

Figure 34:
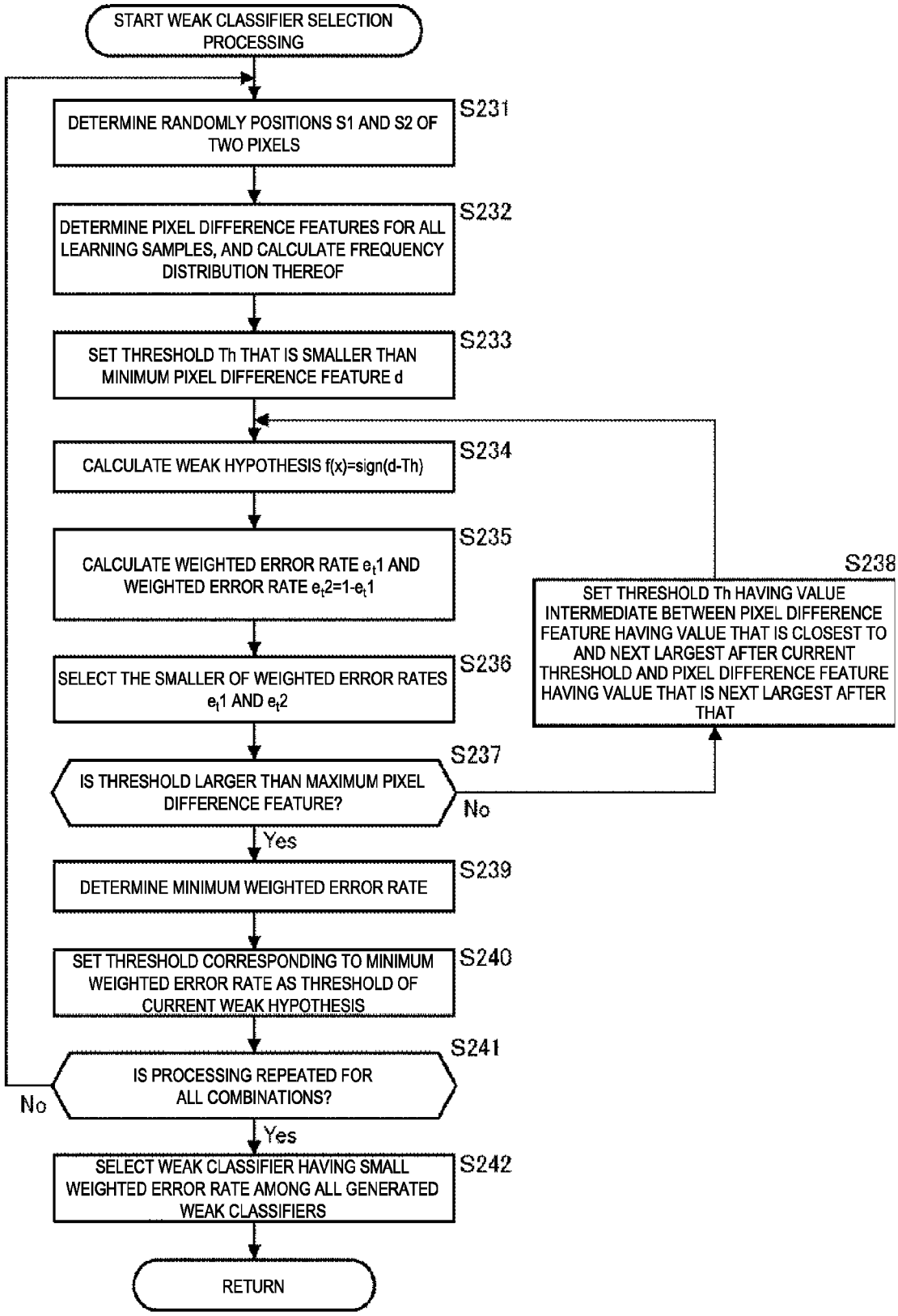
FIG. 34 is a flowchart illustrating selection processing performed by a weak classifier.

FIG. 34 is a flowchart showing a learning method (generation method) performed by the weak classifier in Step S202, the weak classifier performing two-value output using one threshold $Th_1$.

In Step S231, the decision section 521 determines randomly positions S1 and S2 of two pixels from one learning sample (24×24 pixels). In the case of using the learning sample of 24×24 pixels, there are 576×575 ways for selecting two pixels, and one out of 576×575 ways is selected. Here, the positions of the two pixels are represented by S1 and S2, respectively, and the luminance values thereof are represented by $I_1$ and $I_2$, respectively.

In Step S232, the frequency distribution calculation section 522 determines pixel difference features for all learning samples, and calculates the frequency distribution thereof. That is, with respect to all learning samples (the number of which being N), the pixel difference feature d, which is the difference ($I_1-I_2$) between the luminance values $I_1$ and $I_2$ of the pixels at the two positions S1 and S2 selected in Step S231, and the histogram (frequency distribution) thereof is calculated.

Figure 35:
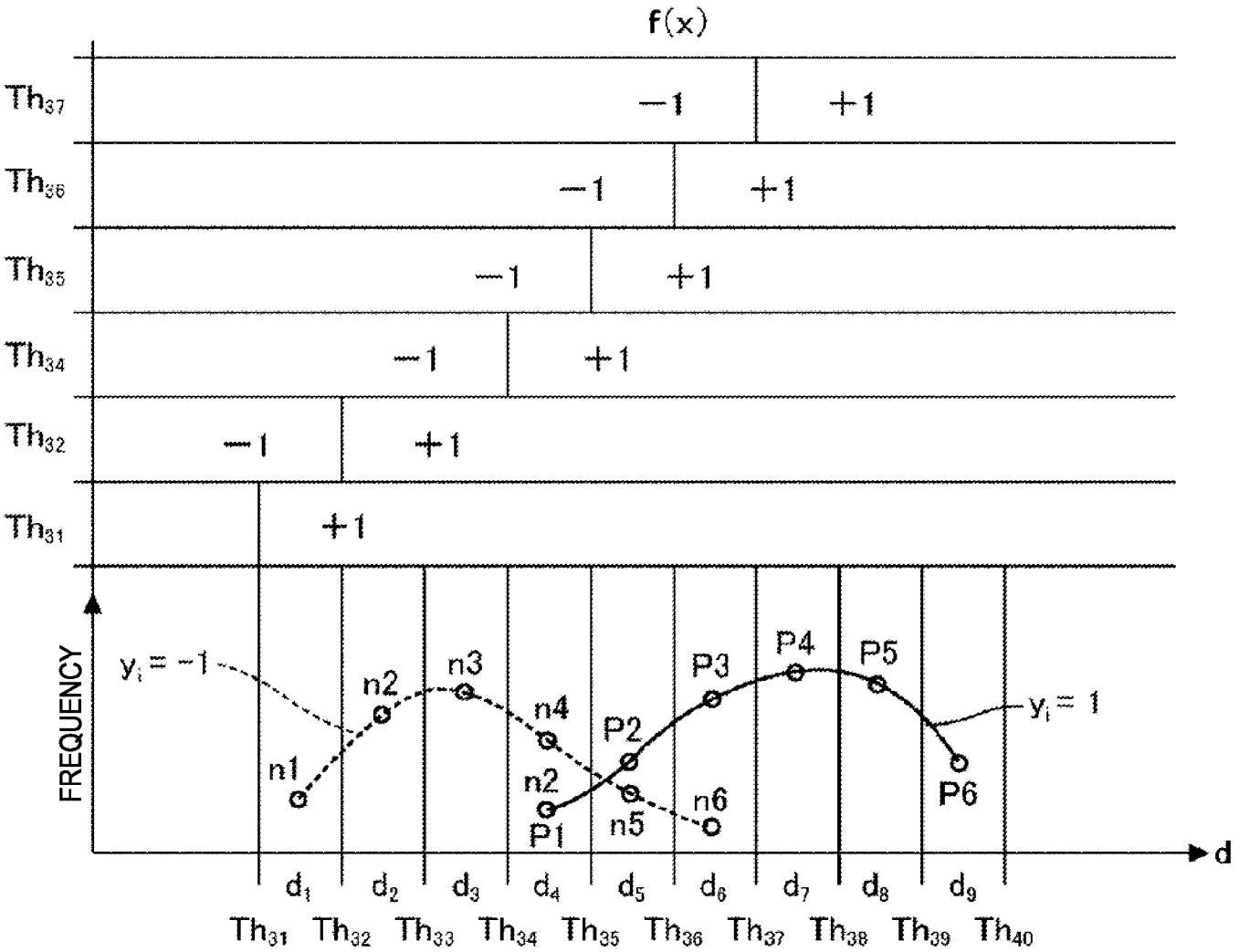
FIG. 35 is a diagram illustrating movement of a threshold.

In Step S233, the threshold setting section 523 sets a threshold Th that is smaller than the minimum pixel difference feature d. For example, as shown in FIG. 35, in the case where the value of the pixel difference feature d is distributed from d1 to d9, the value of the minimum pixel difference feature d is d1. Accordingly, the threshold $Th_{31}$, which is smaller than the pixel difference feature d1, is set as the threshold Th.

Next, in Step S234, the weak hypothesis calculation section 524 operates the next expression as the weak hypothesis. Note that, sign(A) is a function that outputs +1 when a value A is positive, and −1 when the value A is negative.

$$f(x)=\text{sign}(d-Th) \tag{18}$$

In the above case, since $Th=Th_{31}$ is satisfied, the value of d-Th is positive even if the value of the pixel difference feature d is any of d1 to d9. Accordingly, the classification result f(x) of the weak hypothesis represented by Equation (18) is +1.

In Step S235, the weighted error rate calculation section 525 calculates weighted error rates $e_t$1 and $e_t$2. The weighted error rates $e_t$1 and $e_t$2 satisfy the following relationship.

$$e_t2=1-e_t1 \tag{19}$$

The weighted error rate $e_t$1 is a value determined using Equation (8). The weighted error rate $e_t$1 is the weighted error rate where the pixel values of the positions S1 and S2 are represented by I1 and I2, respectively. On the contrary, the weighted error rate $e_t$2 is the weighted error rate where the pixel value of the position S1 is represented by I2 and the pixel value of the position S2 is represented by I1. That is, the combination in which a first position is represented by the position S1 and a second position is represented by the position S2 is different from the combination in which the first position is represented by the position S2 and the second position is represented by the position S1. However, the weighted error rates $e_t$ of the two satisfy the relationship of the above Equation (19). Accordingly, in the processing of Step S235, two combinations are collectively calculated simultaneously. In this way, even though, if the above is not performed, it is necessary to repeat the processing from Steps S231 to Step S241 until it is determined in Step S241 that the number of times repeated has reached the number (K) of all combinations for extracting two pixels from the pixels of the learning sample, the number of repetitions can be set to ½ of the number K of all combinations by calculating the two weighted error rates $e_t$1 and $e_t$2 in Step S235.

Consequently, in Step S236, the weighted error rate calculation section 525 selects the smaller of the weighted error rates $e_t$1 and $e_t$2 calculated in the processing of Step S235.

In Step S237, the determination section 526 determines whether the threshold is larger than the maximum pixel difference feature. That is, it is determined that the threshold Th that is currently set is larger than the maximum pixel difference feature d (for example, d9 in the case of the example shown in FIG. 35). In the above case, since the threshold Th represents the threshold $Th_{31}$ shown in FIG. 35, it is determined that the threshold Th is smaller than the maximum pixel difference feature d9, and the processing proceeds to Step S238.

In Step S238, the threshold setting section 523 sets a threshold Th having a value intermediate between: the pixel difference feature having the value that is closest to and the next largest after the current threshold; and the pixel difference feature having the value that is the next largest after that. In the above case, as shown in the example shown in FIG. 35, the threshold $Th_{32}$ having a value intermediate between: the pixel difference feature d1 having the value that is closest to and the next largest after the current threshold $Th_{31}$; and the pixel difference feature d2 having the value that is the next largest after that.

After that, the processing returns to Step S234, and the weak hypothesis calculation section 524 calculates the determination output f(x) of the weak hypothesis in accordance with the above Equation (18). In this case, as shown in FIG. 35, when the value of the pixel difference feature d is from d2 to d9, the value of f(x) is +1, and when the value of the pixel difference feature d is d1, the value of f(x) is −1.

In Step S235, the weighted error rate $e_t$1 is calculated in accordance with Equation (8), and the weighted error rate $e_t$2 is calculated in accordance with Equation (19). Then, in Step S236, the smaller of the weighted error rates $e_t$1 and $e_t$2 is selected.

In Step S237, it is determined again whether the threshold is larger than the maximum pixel difference feature. In the above case, since the threshold $Th_{32}$ is smaller than the maximum pixel difference feature d9, the processing proceeds to Step S238, and the threshold Th is set to the threshold $Th_{33}$ which is in between the pixel difference features d2 and d3.

In this way, the threshold Th is replaced sequentially with a larger value. In Step S234, for example, in the case where the threshold Th is $Th_{34}$ that is in between the pixel difference features d3 and d4, when the value of the pixel difference feature d is equal to or more than d4, the value of the classification result f(x) is +1, and when the pixel difference feature d is equal to or less than d3, the value of the classification result f(x) is −1. In the same manner, when the value of the pixel difference feature d is equal to or more than the threshold $Th_t$, the value of the classification result f(x) of the weak hypothesis is +1, and when the value of the pixel difference feature d is equal to or less than the threshold $Th_t$, the value of the classification result f(x) of the weak hypothesis is −1.

The processing described above is executed repeatedly until it is determined in Step S237 that the threshold Th is larger than the maximum pixel difference feature. In the example shown in FIG. 35, the processing is repeated until the threshold becomes $Th_{40}$, which is larger than the maximum pixel difference feature d9. That is, by executing repeatedly the processing from Steps S234 to S238, the weighted error rate $e_t$ at the time of setting each threshold Th is determined in the case of selecting one pixel combination. Accordingly, in Step S239, the choosing section 527 determines the minimum weighted error rate from among the weighted error rates $e_t$ that have been determined. Then, in Step S240, the choosing section 527 sets the threshold corresponding to the minimum weighted error rate as the threshold of the current weak hypothesis. That is, the threshold $Th_t$ from which the minimum weighted error rate $e_t$ chosen in Step S239 is obtained is set as the threshold of the weak classifier (weak classifier generated using one pixel combination).

In Step S241, the determination section 526 determines whether the processing is repeated for all combinations. In the case where the processing is still not repeated for all combinations, the processing returns to Step S231, and the processing onward is executed repeatedly. That is, the positions S1 and S2 (provided that the positions are different from those of the previous time) of two pixels are randomly determined from among 24×24 pixels, and the same processing is executed to the pixels 11 and 12 of the positions S1 and S2, respectively.

The above processing is executed repeatedly until it is determined in Step S241 that the number of times repeated has reached the number (K) of all possible combinations for extracting two pixels from the learning sample. However, as described above, in the present embodiment, since the processing of the case of the positions S1 and S2 being opposite is substantially executed in Step S235, the number of times of the processing in Step S241 may be set to ½ of the number K of all combinations.

In the case where it is determined in Step S241 that the processing of all combinations are completed, in Step S242, the choosing section 527 selects the weak classifier having the smallest weighted error rate among the generated weak classifiers. That is, in this way, one weak classifier out of weak classifiers, the number of which being K, is learned and generated.

After that, the processing returns to Step S202 of FIG. 31, and the processing from Step S203 onward is executed. Then, until it is determined in Step S210 that the learning is performed K times, the processing of FIG. 31 is executed repeatedly. That is, in the second processing of FIG. 31, the second weak classifier generation learning is performed, and in the third processing, the third weak classifier generation learning is performed. Then, in the K-th processing, the K-th weak classifier generation learning is performed.

Note that, in the present embodiment, the case has been described in which one weak classifier is generated by learning feature quantities of a plurality of weak classifiers using the data weight $D_{t,i}$ determined in Step S209 of the previous repeating processing and by selecting, from among those weak classifiers (weak classifier candidates), the weak classifier having the smallest weighted error rate $e_t$ shown in the above Equation (8), however, the weak classifier may also be generated, in Step S202 described above, by selecting any pixel position from among a plurality of pixel positions that have been prepared or learned in advance, for example. Further, the weak classifier may also be generated by using a learning sample different from the learning sample used for the repeating processing of Steps S202 to S209 described above. In addition, the generated weak classifier or classifier may be evaluated by preparing a sample other than the learning sample, such as a cross-validation technique or a jack-knife technique. The cross-validation is a technique for evaluating a learning result by equally dividing the learning sample into I pieces, performing learning using those pieces except for one, and repeating I times the operation of evaluating the learning result using the one.

On the other hand, as shown in the above Equation (16) or Equation (17), in the case where the weak classifier has two thresholds $Th_{11}$, $Th_{12}$, $Th_{21}$, $Th_{22}$, the processing of Steps S234 to S238 in FIG. 34 is slightly different. As shown in the above Equation (15), in the case where there is one threshold Th, the weighted error rate $e_t$ can be calculated by subtracting the threshold Th from 1, but as shown in Equation (16), if the case in which the pixel difference feature is larger than the threshold $Th_{12}$ and is smaller than the threshold $Th_{11}$ is a correct classification result, when this is subtracted from 1, the case in which the pixel difference feature is smaller than the threshold $Th_{22}$ or is larger than the threshold $Th_{21}$ is a correct classification result, as shown in Equation (17). That is, the inversion of Equation (16) is Equation (17), and the inversion of Equation (17) is Equation (16).

In the case where the weak classifier has two thresholds $Th_{11}$, $Th_{12}$, $Th_{21}$, $Th_{22}$, and outputs a classification result, in Step S232 shown of FIG. 34, the frequency distribution based on the pixel difference feature is determined, and the threshold $Th_{11}$, $Th_{12}$, $Th_{21}$, $Th_{22}$ rendering the weighted error rate $e_t$ to have the smallest value is determined. After that, it is determined in Step S241 that whether the number of times repeated has reached a predetermined number, and the weak classifier is adopted which has the smallest error rate among the weak classifiers generated by the predetermined number of repetitions.

Figure 20:
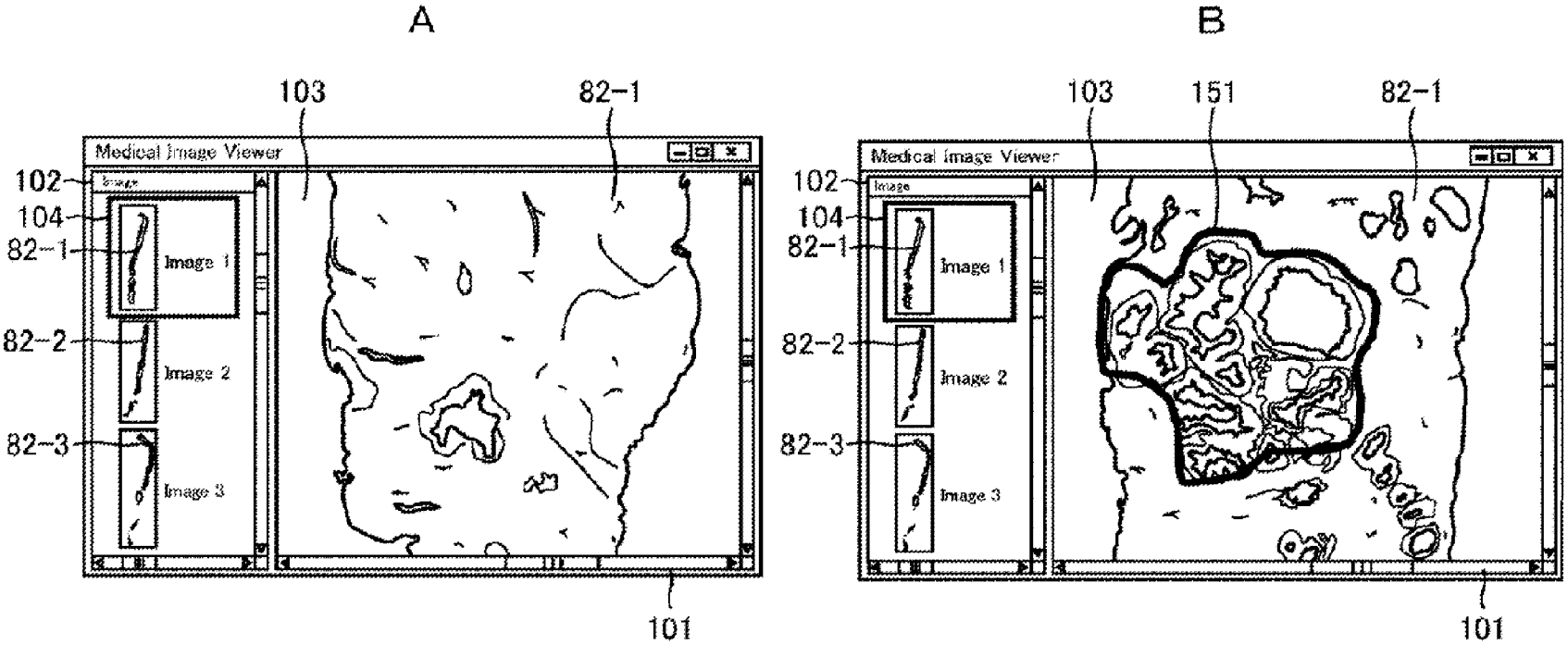
FIG. 20A and FIG. 20B are each a diagram showing an example of highlighting.

Further, as shown in the above Equation (14), in the case of the weak classifier that outputs the continuous value, two pixels are randomly selected first in the same manner as Step S231 of FIG. 20. Then, in the same manner as Step S232, the frequency distribution of all learning samples is determined. In addition, the function f(x) shown in the above Equation (14) is determined based on the obtained frequency distribution. After that, a series of processing is repeated a predetermined number of times, the series of processing involving calculating an error rate in accordance with a predetermined learning algorithm that outputs a degree of being the target object (degree of being correct) as an output of the weak classifier, and a parameter having the smallest error rate (having high percentage of correct answers) is selected, and thus, the weak classifier is generated.

In the generation of the weak classifier shown in FIG. 34, in the case of using the learning sample of 24×24 pixels, for example, there are 331200(=576×575) ways for selecting two pixels, and the one with the smallest error rate after performing the above repeating processing 331200 times at the maximum is adopted as the weak classifier. In this way, the processing is repeated the maximum number of times, that is, the weak classifiers are generated, the number of which being the largest possible, and the one with the smallest error rate is adopted as the weak classifier, which makes it possible to generate a weak classifier with high performance. However, the processing may be repeated the number of times that is less than the maximum number of times, for example, several hundred times, and the one with the smallest error rate may be adopted therefrom.

Note that in the above, although the case of observing the pathology image has been described, the present technology can be applied to the case of observing X-ray images and other medical images. Further, the present technology can be also applied not only to the observation of two-dimensional images, but also to the observation of three-dimensional images such as a CT image obtained by a CT (Computerized Tomography) scanner and an MRI (magnetic resonance imaging) image.

[Application of Present Technology to Program]

The series of processes described above can be executed by hardware, or can be executed by software.

In the case where the series of processes is executed by software, a program constituting the software is installed, from a network or a recording medium, into a computer built in dedicated hardware or, for example, a general-purpose personal computer capable of executing various functions by installing various programs.

The recording medium including such a program is not only configured from, as shown in FIG. 1, the removable medium 31 that is provided separately from the device main body, such as a magnetic disk (including a floppy disk), an optical disk (including a CD-ROM (Compact Disk-Read Only Memory) and a DVD), an magneto-optical disk (including an MD (Mini-Disk)), or a semiconductor memory, which is distributed for providing a user with a program and in which the program is recorded, but is also configured from the flash ROM 22 or a hard disk included in the storage section 28, which is provided to the user in the state of being embedded in the device main body and in which the program is recorded.

Note that in the present specification, the steps for writing the program recorded in the recording medium of course include processing performed in the chronological order in accordance with the stated order, but the processing is not necessarily be processed in the chronological order, and is processed individually or in a parallel manner.

Further, the program executed by a computer may be a program that is processed in time series according to the sequence described in this specification, or may be a program that is processed in parallel or at necessary timing such as upon calling.

It should be understood by those skilled in the art that various modifications, combinations, sub-combinations and alterations may occur depending on design requirements and other factors insofar as they are within the scope of the appended claims or the equivalents thereof.

[Other]

Additionally, the present technology may also be configured as below.

(1) An image processing device including:

a movement section which scrolls a medical image on a screen; and a display control section which, in a case where the medical image is scrolled on the screen, controls a display section to display the medical image in a manner that an observation reference position of a diagnosis region of the medical image passes through a display reference position of a display region of the screen.

(2) The image processing device according to (1), wherein the observation reference position is at a vicinity of a center of a direction perpendicular to a scroll direction of the medical image, and wherein the display reference position is at a vicinity of a center of the display region.

(3) The image processing device according to (1) or (2), wherein it is a case in which scrolling is performed in an automatic mode that the medical image is displayed in a manner that the observation reference position of the diagnosis region passes through the display reference position of the display region of the screen.

(4) The image processing device according to (3), wherein, in a case where the scrolling in the automatic mode is stopped, scrolling in a manual mode can be performed, and the scrolling in the manual mode is performed in a direction indicated by a user.

(5) The image processing device according to (4), wherein, in the case where, after the scrolling in the automatic mode is temporarily stopped, instruction of the scrolling in the automatic mode is issued again in a state where the scrolling in the manual mode is performed in the direction indicated by the user, the scrolling in the automatic mode is restarted from a position at which the scrolling in the automatic mode is stopped.

(6) The image processing device according to any one of (1) to (5), wherein the movement section limits speed of scrolling at an abnormal part in the diagnosis region.

(7) The image processing device according to any one of (1) to (6), wherein the abnormal part in the diagnosis region is highlighted.

(8) The image processing device according to (7), wherein the abnormal part is labelled with a predetermined color.

(9) The image processing device according to any one of (1) to (8), wherein, when reaching an end part of the diagnosis region in a scroll direction, the fact of reaching the end part is displayed.

(10) The image processing device according to (9), further including a detection section which detects the diagnosis region from the medical image.

(11) The image processing device according to any one of (1) to (10), wherein grouping of a plurality of the diagnosis regions included in one medical image is performed, and a diagnosis target image of one group is scrolled.

(12) The image processing device according to (11), wherein the diagnosis region other than an observation target of the medical image is masked.

(13) The image processing device according to any one of (1) to (12), further including a scaling section which, when a width in a direction perpendicular to the scroll direction of the diagnosis region is larger than a reduction threshold which is set based on a width of the display region, reduces the width in the direction perpendicular to the scroll direction of the diagnosis region such that the width in the direction perpendicular to the scroll direction of the diagnosis region is smaller than the width of the display region.

(14) The image processing device according to (13), wherein, when the width in the direction perpendicular to the scroll direction of the diagnosis region is smaller than an enlargement threshold which is set based on the width of the display region, the scaling section enlarges the width in the direction perpendicular to the scroll direction of the diagnosis region within a range smaller than the width of the display region.

(15) An image processing method including:

scrolling a medical image on a screen; and controlling a display section to display, in a case where the medical image is scrolled on the screen, the medical image in a manner that an observation reference position of a diagnosis region of the medical image passes through a display reference position of a display region of the screen.

(16) A computer-readable recording medium having a program recorded therein, the program being for causing a computer to execute a moving step of scrolling a medical image on a screen, and a controlling step of controlling a display section to display, in a case where the medical image is scrolled on the screen, the medical image in a manner that an observation reference position of a diagnosis region of the medical image passes through a display reference position of a display region of the screen.

(17) A program for causing a computer to execute a moving step of scrolling a medical image on a screen, and a controlling step of controlling a display section to display, in a case where the medical image is scrolled on the screen, the medical image in a manner that an observation reference position of a diagnosis region of the medical image passes through a display reference position of a display region of the screen.

What is claimed is:

1. An image processing device comprising:

a movement section which scrolls a medical image on a screen in a scroll direction during a scroll operation;

a display control section which controls a display section to display the medical image in a manner that an observation reference position of a diagnosis region of the medical image passes through a display reference position of a display region of the screen throughout the scroll operation of the medical image on the screen; and a scaling section to (i) determine whether a width in a lateral direction which is perpendicular to the scroll direction of the diagnosis region is equal to or larger than a reduction threshold which is set based on a width of the display region, and (ii) when a determination result thereof indicates that the width of the diagnosis region is equal to or larger than the reduction threshold, reduce only the width of the diagnosis region such that the width in the lateral direction of the diagnosis region is smaller than the width of the display region without reducing a length in the scroll direction of the diagnosis region, so as to enable the medical image to be displayed in the display region throughout the scroll operation without a user having to move the medical image in the lateral direction.

2. The image processing device according to claim 1, wherein the observation reference position is at a vicinity of a center of a direction perpendicular to a scroll direction of the medical image, and wherein the display reference position is at a vicinity of a center of the display region.

3. The image processing device according to claim 2, wherein it is a case in which scrolling is performed in an automatic mode that the medical image is displayed in a manner that the observation reference position of the diagnosis region passes through the display reference position of the display region of the screen.

4. The image processing device according to claim 3, wherein, in a case where the scrolling in the automatic mode is stopped, scrolling in a manual mode can be performed, and the scrolling in the manual mode is performed in a direction indicated by a user.

5. The image processing device according to claim 4, wherein, in the case where, after the scrolling in the automatic mode is temporarily stopped, instruction of the scrolling in the automatic mode is issued again in a state where the scrolling in the manual mode is performed in the direction indicated by the user, the scrolling in the automatic mode is restarted from a position at which the scrolling in the automatic mode is stopped.

6. The image processing device according to claim 5, wherein the movement section limits speed of scrolling at an abnormal part in the diagnosis region.

7. The image processing device according to claim 6, wherein the abnormal part in the diagnosis region is highlighted.

8. The image processing device according to claim 7, wherein the abnormal part is labelled with a predetermined color.

9. The image processing device according to claim 6, wherein, when reaching an end part of the diagnosis region in a scroll direction, the fact of reaching the end part is displayed.

10. The image processing device according to claim 9, further comprising a detection section which detects the diagnosis region from the medical image.

11. The image processing device according to claim 10, wherein grouping of a plurality of the diagnosis regions included in one medical image is performed, and a diagnosis target image of one group is scrolled.

12. The image processing device according to claim 11, wherein the diagnosis region other than an observation target of the medical image is masked.

13. The image processing device according to claim 1, wherein, when the determination result indicates that the width of the diagnosis region not equal to or larger than the reduction threshold, the scaling section determines whether the width is smaller than an enlargement threshold which is set based on the width of the display region, and when a determination result thereof indicates that the width is smaller than the enlargement threshold, the scaling section enlarges the width in the lateral direction of the diagnosis region within a range smaller than the width of the display region.

14. An image processing method comprising:

scrolling a medical image on a screen in a scroll direction;

controlling a display section to display the medical image in a manner that an observation reference position of a diagnosis region of the medical image passes through a display reference position of a display region of the screen throughout the scrolling of the medical image on the screen;

determining whether a width in a lateral direction which is perpendicular to the scroll direction of the diagnosis region is equal to or larger than a reduction threshold which is set based on a width of the display region; and when a determination result indicates that the width of the diagnosis region is equal to or larger than the reduction threshold, reducing only the width of the diagnosis region such that the width in the lateral direction of the diagnosis region is smaller than the width of the display region without reducing a length in the scroll direction of the diagnosis region, so as to enable the medical image to be displayed in the display region throughout the scroll operation without a user having to move the medical image in the lateral direction.

15. A non-transitory computer-readable recording medium having a program recorded therein, the program being for causing a computer to execute:

a moving step of scrolling a medical image in a scrolling direction on a screen;

a controlling step of controlling a display section to display the medical image in a manner that an observation reference position of a diagnosis region of the medical image passes through a display reference position of a display region of the screen throughout the scrolling of the medical image on the screen;

a determining step of determining whether a width in a lateral direction which is perpendicular to the scroll direction of the diagnosis region is equal to or larger than a reduction threshold which is set based on a width of the display region; and when a determination result indicates that the width of the diagnosis region is equal to or larger than the reduction threshold, a reducing step of reducing only the width of the diagnosis region such that the width in the lateral direction of the diagnosis region is smaller than the width of the display region without reducing a length in the scroll direction of the diagnosis region, so as to enable the medical image to be displayed in the display region throughout the scroll operation without a user having to move the medical image in the lateral direction.

16. An image processing apparatus for controlling display of a medical image on a display screen, said image processing apparatus comprising:

an input device to enable a user to select a scroll operation in which the medical image is scrolled on the display screen in a scroll direction; and a processing device to control the display of the medical image in response to selection of the scroll operation by the user such that an observation reference position of a diagnosis region of the medical image passes through a display reference position of a display region of the display screen throughout the scroll operation of the medical image, said processing device configured to (i) determine whether a width in a lateral direction which is perpendicular to the scroll direction of the diagnosis region is equal to or larger than a reduction threshold which is set based on a width of the display region, and (ii) when a determination result thereof indicates that the width of the diagnosis region is equal to or larger than the reduction threshold, reduce only the width of the diagnosis region such that the width in the lateral direction of the diagnosis region is smaller than the width of the display region without reducing a length in the scroll direction of the diagnosis region, so as to enable the medical image to be displayed in the display region throughout the scroll operation without a user having to move the medical image in the lateral direction, wherein the observation reference position is at a vicinity of a center of a direction perpendicular to the scroll direction, and wherein the display reference position is at a vicinity of a center of the display region.

* * * * *